US012408803B2

(12) United States Patent
Choi et al.

(10) Patent No.: US 12,408,803 B2
(45) Date of Patent: Sep. 9, 2025

(54) CLEANING DEVICE AND CONTROLLING METHOD THEREOF

(71) Applicant: Samsung Electronics Co., Ltd., Suwon-si (KR)

(72) Inventors: Ingyu Choi, Suwon-si (KR); Seehyun Kim, Suwon-si (KR); Hyunho Lee, Suwon-si (KR); Hyeoncheol Kim, Suwon-si (KR); Hyunju Lee, Suwon-si (KR); Seungryong Cha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 231 days.

(21) Appl. No.: 17/865,913

(22) Filed: Jul. 15, 2022

(65) Prior Publication Data

US 2023/0117115 A1 Apr. 20, 2023

Related U.S. Application Data

(63) Continuation of application No. PCT/KR2022/010171, filed on Jul. 13, 2022.

(30) Foreign Application Priority Data

Oct. 15, 2021 (KR) ..... 10-2021-0137729

(51) Int. Cl.
*A47L 9/00* (2006.01)
*A47L 5/28* (2006.01)
(Continued)

(52) U.S. Cl.
CPC ..... *A47L 9/149* (2013.01); *A47L 5/28* (2013.01); *A47L 9/0063* (2013.01); *A47L 9/248* (2013.01)

(58) Field of Classification Search
CPC ..... A47L 9/149; A47L 9/0063; A47L 9/248; A47L 5/28
(Continued)

(56) References Cited

U.S. PATENT DOCUMENTS 5,647,569 A * 7/1997 Sofy ..... A47G 33/126 248/522
9,929,588 B2 3/2018 Ireland et al.
(Continued)

FOREIGN PATENT DOCUMENTS

CN 211704439 U * 10/2020
CN 211704440 U 10/2020
(Continued)

OTHER PUBLICATIONS

International Search Report and Written Opinion dated Nov. 8, 2022, issued in International Application No. PCT/KR2022/010171.

*Primary Examiner* — Edward F Landrum
*Assistant Examiner* — Caleb Andrew Holizna
(74) *Attorney, Agent, or Firm* — Jefferson IP Law, LLP

(57) ABSTRACT

A cleaning device including a cleaner and a station on which the cleaner is mounted is provided. The cleaner includes a suction head, a dust container to collect dust contained in air vacuumed through the suction head, and an extension tube connecting the suction head with the dust container. The station includes a main body configured to suck dust of the dust container of the cleaner and contain the dust, a support configured to support the main body and guide rotation of the main body, and a rotation driving device disposed in the support and configured to transmit a rotational force to the support.

14 Claims, 31 Drawing Sheets

(51) Int. Cl.
*A47L 9/14* (2006.01)
*A47L 9/24* (2006.01)

(58) Field of Classification Search
USPC ..... 15/356
See application file for complete search history.

(56) References Cited

U.S. PATENT DOCUMENTS

| | | | | |
|---|---|---|---|---|
| 2021/0000313 | A1 | 1/2021 | Canning et al. | |
| 2021/0369072 | A1 | 12/2021 | Gao | |
| 2023/0329500 | A1 | 10/2023 | Jeon et al. | |
| 2023/0404343 | A1* | 12/2023 | Kim | A47L 9/0063 |

FOREIGN PATENT DOCUMENTS

| | | | |
|---|---|---|---|
| CN | 214048676 | U | 8/2021 |
| EP | 3878337 | A1 | 9/2021 |
| JP | 2016-123746 | A | 7/2016 |
| JP | 6078009 | B2 | 2/2017 |
| JP | 2017-189453 | A | 10/2017 |
| JP | 2021-181004 | A | 11/2021 |
| KR | 10-1985314 | B1 | 9/2019 |
| KR | 10-2020-0073966 | A | 6/2020 |
| KR | 10-2020-0116992 | A | 10/2020 |
| KR | 10-2166771 | B1 | 10/2020 |
| KR | 10-2166773 | B1 | 10/2020 |
| KR | 10-2022-0077608 | A | 6/2022 |
| WO | 2021/177699 | A1 | 9/2021 |

* cited by examiner

CLEANING DEVICE AND CONTROLLING METHOD THEREOF

CROSS-REFERENCE TO RELATED APPLICATION(S)

This application is a continuation application, claiming priority under § 365(c), of an International application No. PCT/KR2022/010171, filed on Jul. 13, 2022, which is based on and claims the benefit of a Korean patent application number 10-2021-0137729, filed on Oct. 15, 2021, in the Korean Intellectual Property Office, the disclosure of which is incorporated by reference herein in its entirety.

TECHNICAL FIELD

The disclosure relates to a cleaning device having improved convenience for use and a controlling method thereof.

BACKGROUND ART

Vacuum cleaners generally include a fan motor configured to generate a suction force. Vacuum cleaners are apparatuses that suck foreign matter, such as dust, together with air by the suction force generated in the fan motor, separate the foreign matter contained in the sucked air from the air, and collect the separated foreign matter, thereby performing cleaning.

A vacuum cleaner includes a dust container to collect foreign matter, and a user should periodically remove the collected foreign matter from the dust container by separating the dust container from the vacuum cleaner.

The above information is presented as background information only to assist with an understanding of the disclosure. No determination has been made, and no assertion is made, as to whether any of the above might be applicable as prior art with regard to the disclosure.

DISCLOSURE

Technical Problem

Aspects of the disclosure are to address at least the above-mentioned problems and/or disadvantages and to provide at least the advantages described below. Accordingly, an aspect of the disclosure is to provide a cleaning device having improved convenience for use.

Another aspect of the disclosure is to provide a cleaning device easily mounted on a station and easily separated from the station.

Additional aspects will be set forth in part in the description which follows and, in part, will be apparent from the description, or may be learned by practice of the presented embodiments.

Technical Solution

In accordance with an aspect of the disclosure, a cleaning device is provided. The cleaning device includes a cleaner including a suction head, a dust container to collect dust contained in air vacuumed through the suction head, and an extension tube connecting the suction head with the dust container, and a station on which the cleaner is mounted, wherein the station includes a main body configured to suck dust of the dust container of the cleaner and contain the dust, a support configured to support the main body and guide rotation of the main body, and a rotation driving device disposed in the support and configured to transmit a rotational force to the support.

The support includes a first support supported by a floor and a second support coupled to the main body and rotatable with respect to the first support.

The rotation driving device includes a driving motor disposed at one of the first support and the second support and including a rotary shaft, a first gear connected to the rotary shaft of the driving motor and receiving the rotational force from the driving motor, and a second gear disposed at the other of the first support and the second support and engaged with the first gear.

The station further includes a sensor configured to detect at least one of whether the cleaner is mounted or whether a user is present within a preset distance from the station, and a processor configured to control the rotation driving device to rotate the support based on information detected by the sensor.

The main body of the station further includes an extension tube guide provided to correspond to the extension tube of the cleaner in a state where the cleaner is mounted on the station, wherein in response to separation of the cleaner from the station, the processor is further configured to control the rotation driving device to rotate the support, thereby locating the extension tube guide to face a forward direction of the main body of the station.

The processor is further configured to control the rotation driving device after a lapse of a preset time from the separation of the cleaner from the station.

Upon detection of a user present within a preset distance from the station in a state where the cleaner is mounted on the station, the processor is further configured to control the rotation driving device to rotate the support, thereby locating the extension tube of the cleaner at a front of the main body of the station.

In the case where the cleaner is not separated from the station for a preset time after the support rotates, the processor may control the rotation driving device to rotate the support, thereby locating the extension tube of the cleaner at a rear of the main body of the station.

In response to mounting of the cleaner on the station after the cleaner is separated from the station, the processor is further configured to control the rotation driving device to rotate the support, thereby locating the extension tube of the cleaner at a rear of the main body of the station.

In the case where the cleaner is separated from the station while the rotation driving device is controlled in a state where the cleaner is mounted on the station, the processor is further configured to stop the rotation driving device.

The station may further include an inputter configured to receive an input from a user.

The processor is further configured to set at least one of an On/Off of rotation of the support, a rotation range of the support, a rotation direction of the support, and a rotational speed of the support, based on a user input received via the inputter.

The processor is further configured to control whether to activate an operation of controlling rotation of the support or not based on a user input received via the inputter.

The first support may further include a support member provided to support a bottom of the second support and reduce a frictional force between the first support and the second support.

A plurality of support members may be provided and arranged along the circumferential direction of the first support to be spaced apart from each other.

The second support may further include a protrusion extending downward from the bottom of the second support, and the first support may further include a recess in which the protrusion of the second support is rotatably accommodated, and a stopper extending from the recess toward the protrusion to prevent dislocation of the protrusion.

In accordance with another aspect of the disclosure, a method of controlling a cleaning device including a cleaner and a station on which the cleaner is mounted is provided. The method includes detecting at least one of whether the cleaner is mounted on the station or not or whether the user is present within a preset distance from the station or not using an output from the sensing unit of the station, and controlling the rotation driving device configured to transmit a rotational force to the support configured to support the main body of the station based on information obtained by the sensing unit.

The main body of the station may further include an extension tube guide provided to correspond to the extension tube of the cleaner in a state where the cleaner is mounted on the station, and the controlling of the rotation driving device may include controlling the rotation driving device to rotate the support, thereby locating the extension tube guide to face the forward direction of the main body of the station, in response to separation of the cleaner from the station.

The controlling of the rotation driving device may include controlling the rotation driving device after a laps of a preset time after separation of the cleaner from the station.

The controlling of the rotation driving device may include controlling the rotation driving device to rotate the support, thereby locating the extension tube of the cleaner at the front of the main body of the station, upon detection of a user present within a preset distance from the station in a state where the cleaner is mounted on the station.

Advantageous Effects

Because the cleaning device includes a rotatable station according to the disclosure, mounting and separating of the cleaner may be easily performed.

Because the cleaning device includes a station enabling various rotational operations in accordance with a user input according to the disclosure, the convenience for use may be improved.

According to the disclosure, the cleaning device may be arranged in a state where the appearance is considered.

Other aspects, advantages, and salient features of the disclosure will become apparent to those skilled in the art from the following detailed description, which, taken in conjunction with the annexed drawings, discloses various embodiments of the disclosure.

DESCRIPTION OF DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

MODES OF THE INVENTION

Figure 1:
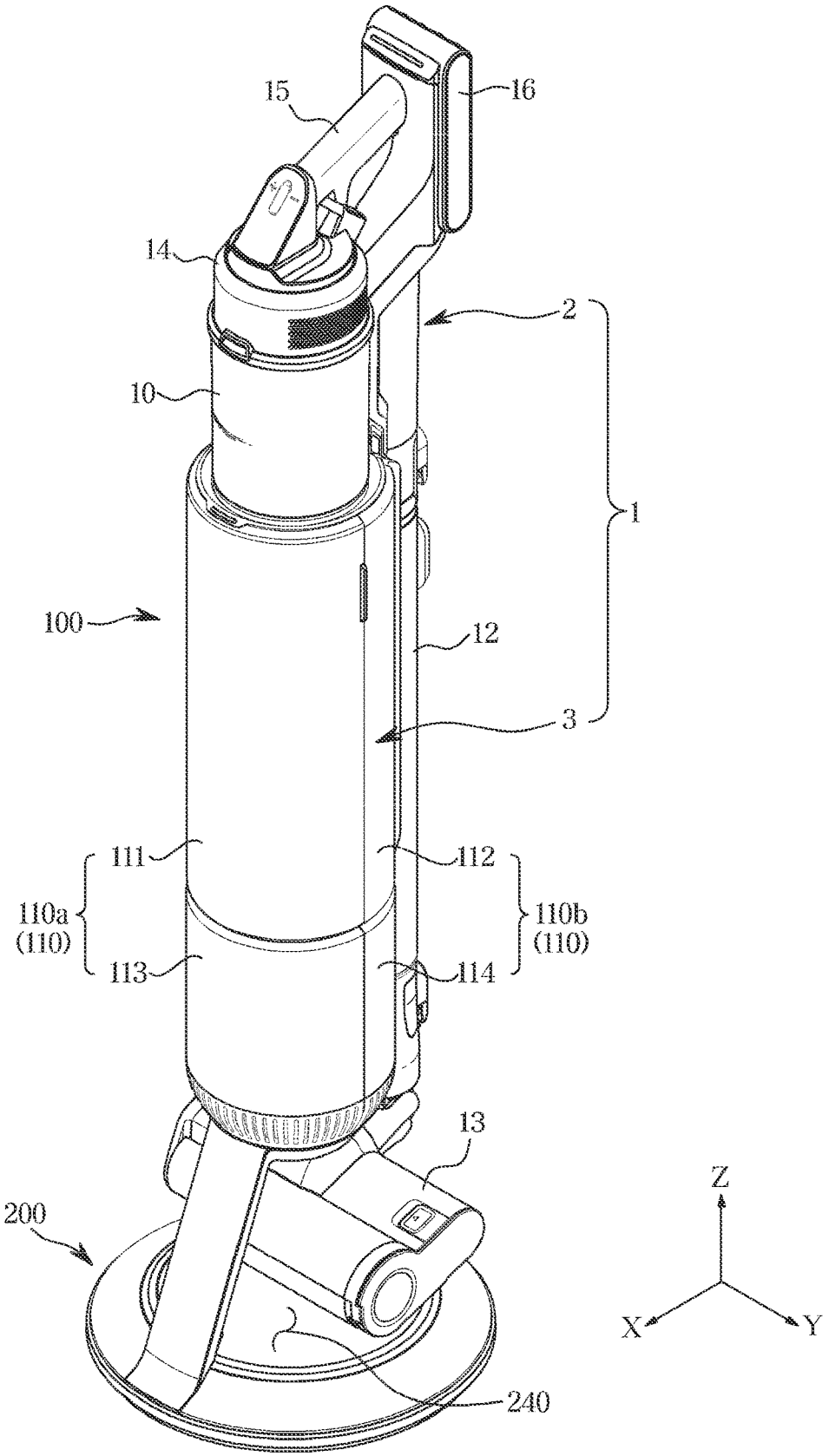
FIG. 1 illustrates a cleaning device according to an embodiment of the disclosure.

The following description with reference to the accompanying drawings is provided to assist in a comprehensive understanding of various embodiments of the disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the disclosure. Accordingly, it should be apparent to those skilled in the art that the following description of various embodiments of the disclosure is provided for illustration purposes only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In addition, like reference numerals denote like elements or components having substantially same functions in the drawings.

Also, the terms used herein are merely used to describe particular embodiments, and are not intended to limit the disclosure. An expression used in the singular encompasses the expression of the plural, unless otherwise indicated. Throughout the specification, the terms such as "including" or "having" are intended to indicate the existence of features, numbers, operations, components, parts, or combinations thereof disclosed in the specification, and are not intended to preclude the possibility that one or more other features, numbers, operations, components, parts, or combinations thereof may exist or may be added.

In addition, throughout the specification, when an element is referred to as being "connected to" or "coupled to" another element, the element may be directly connected to or coupled to the other element, or the element may also be indirectly connected to or coupled to the other element.

Also, although the terms "first", "second", and the like may be used herein to describe various elements, these elements should not be limited by these terms. These terms are only used to distinguish one element from another element. For example, a first component discussed below could be termed a second component, and similarly, the second component may be termed the first component without departing from the teachings of the disclosure. As used herein, the term "and/or" includes any combinations of one or more of the associated listed items.

The terms used throughout the specification "front", "rear", "forward-backward direction", "vertical direction", and the like are defined based on the drawings and the shape and position of each element are not limited by these terms.

For example, a direction in which a station 3 extends may be defined as a vertical direction (Z direction). In addition, as shown in FIG. 1, a direction a suction head 13 of a cleaner 2 faces in a state where the cleaner 2 is placed on the station 3 may be defined as a forward direction (+X direction), and a direction an extension tube 12 of the cleaner 2 faces may be defined as a backward direction (−X direction). However, they are merely examples, and the disclosure is not limited by these definitions.

Hereinafter, embodiments of the disclosure will be described in detail with reference to the accompanying drawings.

Figure 2:
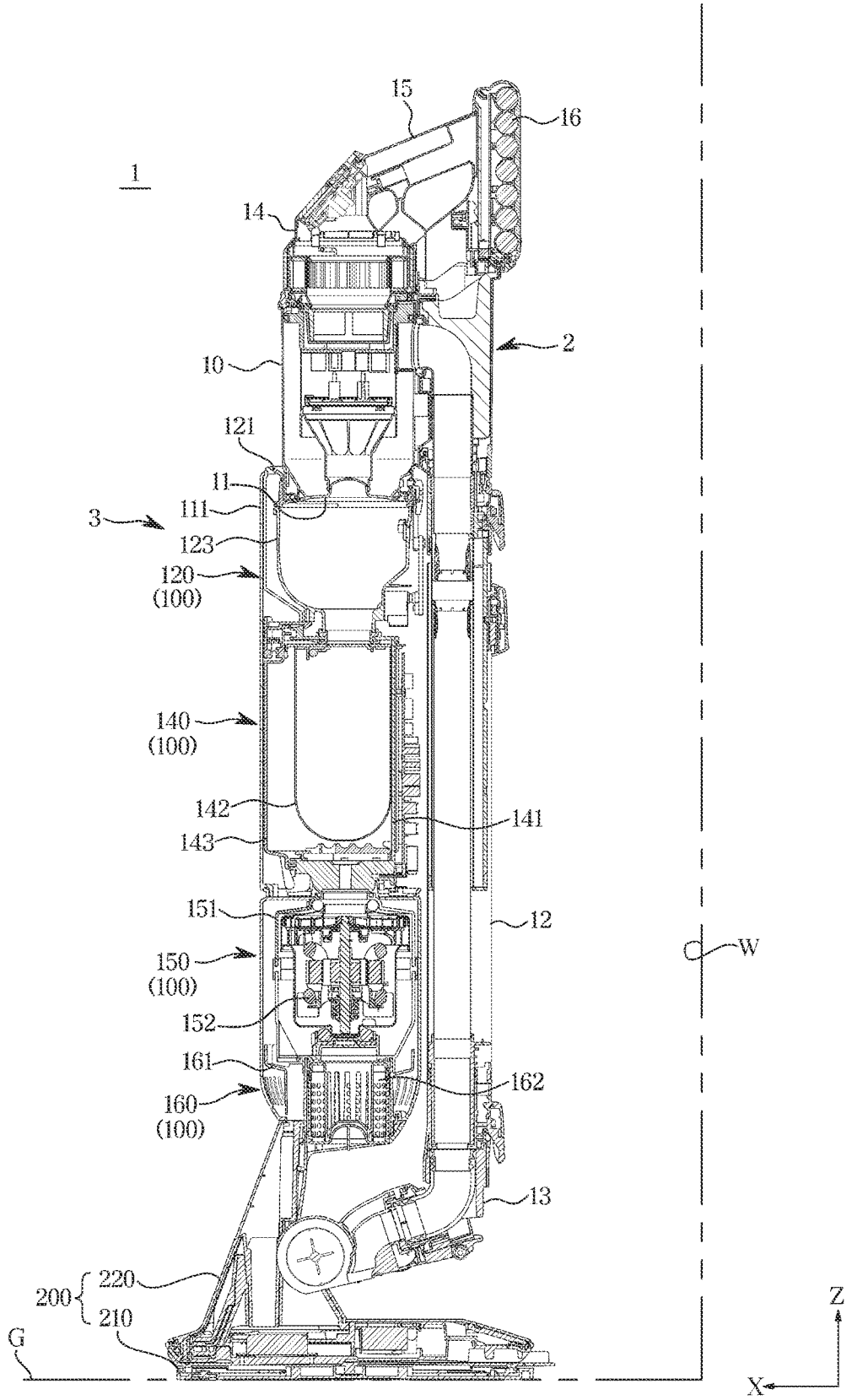
FIG. 2 illustrates a side cross-section of a cleaning device according to an embodiment of the disclosure.
Figure 3:
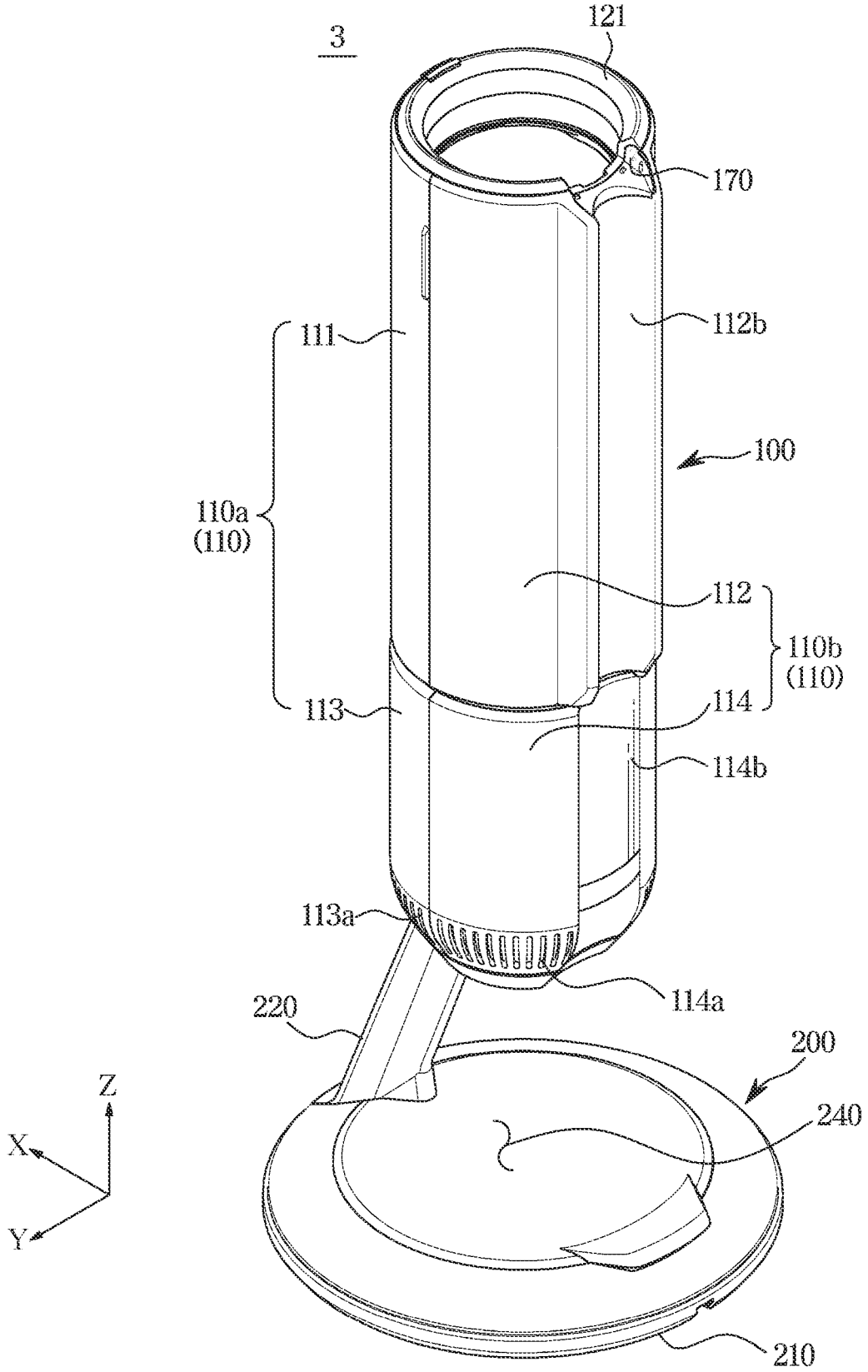
FIG. 3 illustrates a station according to an embodiment of the disclosure.

FIG. 1 illustrates a cleaning device according to an embodiment of the disclosure. FIG. 2 illustrates a side cross-section of a cleaning device according to an embodiment of the disclosure. FIG. 3 illustrates a station according to an embodiment of the disclosure.

Referring to FIGS. 1 and 2, a cleaning device 1 may include a cleaner 2 and a station 3 on which the cleaner 2 is mounted. The cleaner 2 may be placed on the station 3 to be coupled thereto.

The cleaner 2 may include a cleaner body 14 and a dust container 10 detachably coupled to the cleaner body 14. The dust container 10 may be provided to collect foreign matter moved into the cleaner 2.

The cleaner body 14 may include a suction motor (not shown) configured to generate a suction force required to vacuum foreign matter on a surface to be cleaned, and the dust container 10 accommodating the foreign matter sucked from the surface to be cleaned.

The dust container 10 may be configured to filter out contaminants (such as dust and foreign matter) from air introduced through the suction head 13 and store the contaminants A dust container cover 11 to open and close the dust container 10 may be provided at the bottom of the dust container 10. The dust container cover 11 may be rotatably provided. By rotating the dust container cover 11 while the cleaner 2 is mounted on the station 3, dust contained in the dust container 10 may move to the station 3.

The cleaner body 14 may include a filter housing. The filter housing may be provided in an approximately donut shape to accommodate a filter (not shown). Although types of the filter are not particularly limited, a HEPA filter may be located inside the filter housing. The filter may filter out ultrafine dust, and the like, which are not filtered out by the dust container 10.

The cleaner body 14 may include a handle 15 gripped by a user and allowing the user to control the cleaner 2. The user may clean by moving the cleaner 2 while holding the handle 15.

The cleaner body 14 may further include a cleaner controller. The user may turn on/off the cleaner 2 or adjust suction force by manipulating a power button provided at the cleaner controller.

The cleaner 2 may further include an extension tube 12 detachably coupled to the cleaner body 14 and a suction head 13 detachably coupled to the extension tube 12.

The suction head 13 may be provided to vacuum external foreign matter into the cleaner 2. The extension tube 12 may be provided to connect the cleaner body 14 with the suction head 13 to form a path through which the foreign matter moves. The foreign matter may pass through the cleaner body 14 to be collected by the dust container 10. The extension tube 12 may be provided to connect the suction head 13 with the dust container 10.

While the cleaner 2 is coupled to the station 3, the suction head 13 may be accommodated in an accommodation space 240 formed in the station 3.

The cleaner 2 may further include a battery 16. The battery 16 may be detachably mounted on the cleaner 2.

In addition, the battery 16 may be electrically connected to a charging terminal 170 provided at the station 3. The battery 16 may be charged upon receiving power from the charging terminal 170 provided at the station 3. In other words, the cleaner 2 may be docked on the station 3 and then charged by the station 3.

Referring to FIG. 3, the station 3 may include a station main body (also referred to as a main body of the station) 100 and a support 200 supporting the station main body 100. The station 3 may further include a rotation driving device 300 configured to transmit a rotational force to the support 200.

The main body 100 of the station 3 may include a housing 110. For example, the housing 110 may include a first housing 110*a* and a second housing 110*b*. The first housing 110*a* and the second housing 110*b* may be provided as separate components and coupled to each other. However, the embodiment is not limited thereto, and the first housing 110*a* and the second housing 110*b* may be integrally formed.

Hereinafter, an example of the housing 110 will be described.

The first housing 110*a* may define a front exterior. The first housing 110*a* may include a first upper housing 111 and a first lower housing 113.

The second housing 110*b* may define a rear exterior. The second housing 110*b* may include a second upper housing 112 and a second lower housing 114.

The first upper housing 111 and the second upper housing 112 may define an upper exterior. The first upper housing 111 and the second upper housing 112 may be coupled with each other to define the upper exterior of the station 3. The first upper housing 111 and the second upper housing 112 may be integrally formed. A duct unit 120 and a trap 140 may be accommodated inside the first upper housing 111 and the second upper housing 112.

The first upper housing 111 and the second upper housing 112 may be provided to have major axes extending in one direction. The major axes of the first upper housing 111 and the second upper housing 112 may be provided to extend in the vertical direction. The first upper housing 111 and the second upper housing 112 may be formed to have curved surfaces. For example, the first upper housing 111 and the second upper housing 112 may be coupled to form an approximately cylindrical shape.

The first lower housing 113 and the second lower housing 114 may define a lower exterior of the station 3. The first lower housing 113 and the second lower housing 114 may be coupled with each other to define the lower exterior of the station 3. The first lower housing 113 and the second lower housing 114 may be integrally formed. A suction device 150 and an exhaust filter 160 may be accommodated inside the first lower housing 113 and the second lower housing 114.

The first lower housing 113 may be coupled to the bottom of the first upper housing 111. The second lower housing 114 may be coupled to the bottom of the second upper housing 112.

The first lower housing 113 and the second lower housing 114 may be provided to have major axes extending in one direction. The major axes of the first lower housing 113 and the second lower housing 114 may be provided to extend in the vertical direction. The first lower housing 113 and the second lower housing 114 may be formed to have curved surfaces. The first lower housing 113 and the second lower housing 114 may be coupled to form an approximately cylindrical shape.

For example, the major axis of the first lower housing 113 may be provided to be shorter than the major axis of the first upper housing 111, and the major axis of the second lower housing 114 may be provided to be shorter than the major axis of the second upper housing 112. However, the major axes of the first lower housing 113 and the second lower housing 114 may be provided to be the same as or longer than the major axes of the first upper housing 111 and the second upper housing 112.

The station 3 may include extension tube guides 112*b* and 114*b* provided to correspond to the extension tube 12 of the cleaner 2 in a state where the cleaner 2 is mounted on the station 3. For example, the extension tube guides 112*b* and 114*b* may include a first guide 112*b* and a second guide 114*b*.

The first guide 112*b* may be formed at the second upper housing 112. The first guide 112*b* may be formed by partially recessing the second upper housing 112 inward. The first guide 112*b* may extend along the major axis of the second upper housing 112. The extension tube 12 of the cleaner 2 may be partially accommodated in the first guide 112*b*.

The second guide 114*b* may be formed at the second lower housing 114. The second guide 114*b* may be formed by partially recessing the second lower housing 114 inward. The second guide 114*b* may extend along the major axis of the second lower housing 114. The extension tube 12 of the cleaner 2 may be partially accommodated in the second guide 114*b*.

By vertically aligning the second upper housing 112 and the second lower housing 114, the first guide 112*b* and the second guide 114*b* may be connected in the vertical direction. An upper part of the extension tube 12 of the cleaner 2 may be accommodated in the first guide 112*b*, and a lower part of the extension tube 12 of the cleaner 2 may be accommodated in the second guide 114*b*.

The first lower housing 113 may have first exhaust holes 113*a*. The second lower housing 114 may have second exhaust holes 114*a*. Because the first lower housing 113 and the second lower housing 114 accommodate the suction device 150 therein, the air needs to be discharged to the outside. To this end, each of the first lower housing 113 and the second lower housing 114 may allow the air flowing through the suction device 150 to pass through the exhaust filter 160 and then to be discharged out of the first lower housing 113 and the second lower housing 114 by including the first exhaust holes 113*a* and the second exhaust holes 114*a*.

Referring to FIGS. 1 to 3, the first housing 110*a* may be located to face a first side. The second housing 110*b* may be located to face a second side opposite to the first side. For example, the first housing 110*a* may be located to face the forward direction (+X direction) of the station 3, and the second housing 110*b* may be located to face the backward direction (−X direction) of the station 3. For example, the second housing 110*b* may be located to face a wall W.

The locating of the first housing 110*a* to face the first side and locating of the second housing 110*b* to face the second side means that both components face opposite directions, but does not mean that the first housing 110*a* is fixed to face the first side (e.g., forward direction) and the second housing 110*b* is fixed to face the second side (e.g., backward direction).

For a clean and tidy appearance of the cleaning device 1, the cleaning device 1 may be located such that the components such as the extension tube 12 of the cleaner 2 and the guides 112*b* and 114*b* of the station 3 are not seen by the user. For example, the first housing 110*a* having a relatively clean and tidy appearance may be located to face the forward direction of the station 3. However, this is only an example of arrangement of the cleaning device 1 recommended to improve appearance.

The directions to which the first housing 110*a* and the second housing 110*b* may vary according to rotation of the support 200 of the station 3, and this will be described below in more detail.

The main body 100 of the station 3 may include a duct unit 120, a trap 140, a suction device 150, and an exhaust filter 160 accommodated in the housing 110.

The main body 100 of the station 3 may include the duct unit 120 accommodated inside the housing 110. For example, the duct unit 120 may be provided inside the first upper housing 111 and the second upper housing 112.

The duct unit 120 may be provided to guide the contaminants contained in the dust container 10 of the cleaner 2 to the trap 140. For example, the duct unit 120 may include a docking frame 121 and a duct 123.

The dust container 10 of the cleaner 2 may be placed on the docking frame 121. For example, the docking frame 121 may be provided to expose the charging terminal 170 to the outside. The charging terminal 170 may be in contact with a charger (not shown) of the cleaner 2 to supply power to the cleaner 2. The cleaner 2 may be placed on the station 3 and then charged. The docking frame 121 may be provided in an approximately hollow annular shape.

The duct 123 may guide the contaminants collected in the dust container 10 of the cleaner 2 to the trap 140. The duct 123 may be provided to allow the contaminants collected in the dust container 10 of the cleaner 2 to move to a dust bag 142 of the trap 140. The duct 123 may communicate with the dust container 10 of the cleaner 2 and the dust bag 142 of the trap 140.

The main body 100 of the station 3 may include the trap 140 accommodated in the housing 110. For example, the trap 140 may be provided inside the first upper housing 111 and the second upper housing 112.

The trap 140 may be provided to trap contaminants of the dust container 10 of the cleaner 2 introduced through the duct unit 120. The trap 140 may be located below the duct unit 120.

The trap 140 may include the dust bag 142. The trap 140 may further include a mounting frame 141 to accommodate the dust bag 142 and a dust bag cover 143. The mounting frame 141 and the dust bag cover 143 may be detachably coupled with each other.

The dust bag 142 may be provided to store dust introduced from the dust container 10 of the cleaner 2. Foreign matter passing through the duct unit 120 may be contained in the dust bag 142. The dust bag 142 may communicate with the duct 123.

The dust bag 142 may be accommodated in the mounting frame 141 and the dust bag cover 143. The dust bag 142 may be detachably coupled to the mounting frame 141.

The trap 140 may include a filter (not shown) on which foreign matter that could not flow into the dust bag 142 is collected. The filter may prevent foreign matter from entering the suction device 150.

The main body 100 of the station 3 may include the suction device 150 accommodated in the housing 110. For example, the suction device 150 may be located inside the first lower housing 113 and the second lower housing 114. The suction device 150 may be located below the trap 140.

The suction device 150 may be provided to suck the contaminants of the dust container 10 of the cleaner 2. For example, the device 150 may include a driving device 152. The driving device 152 may generate a suction force by providing a power. The driving device 152 may include components such as a motor and a fan. The driving device 152 may generate an air flow to suck the contaminants of the dust container 10 of the cleaner 2. The suction device 150 may further include a motor cover 151 to accommodate the driving device 152.

The main body 100 of the station 3 may include the exhaust filter 160 accommodated in the housing 110. For example, the exhaust filter 160 may be provided inside the first lower housing 113 and the second lower housing 114. The exhaust filter 160 may be located below the suction device 150.

For example, the exhaust filter 160 may include a filter 162 and a filter cover 161 provided to accommodate the filter 162. The filter 162 may filter out foreign matter contained in the air passing through the exhaust filter 160. The filter cover 161 may be coupled to the motor cover 151.

The air flowing from the upper side of the station 3 through the suction device 150 may pass through the exhaust filter 160. The air passing through the exhaust filter 160 may be discharged to the outside through the first exhaust hole 113*a* of the first lower housing 113 and the second exhaust hole 114*a* of the second lower housing 114.

The support 200 of the station 3 may be provided to support the main body 100 of the station 3. The support 200 may be coupled to the housing 110 of the main body 100 of the station 3. The support 200 may be coupled to the bottom of the main body 100 of the station 3. The support 200 may be coupled to the first lower housing 113 and the second lower housing 114.

The support 200 may be coupled to the main body 100 of the station 3 to form the accommodation space 240 in which the suction head 13 of the cleaner 2 is accommodated.

The support 200 may be provided to guide rotation of the main body 100 of the station 3. The support 200 may be provided rotatable with respect to the ground G.

The support 200 may include a first support 210 supported by the ground and a second support 220 rotatable with respect to the first support 210. The second support 220 may be coupled to the main body 100 of the station 3. The top of the second support 220 may be coupled to the main body 100 of the station 3, and the bottom of the second support 220 may be rotatably coupled to the first support 210. As the second support 220 rotates with respect to the first support 210, the main body 100 of the station 3 coupled to the second support 220 may rotate with respect to the first support 210.

The station 3 may include the rotation driving device 300 provided to transmit a rotational force to the support 200. The rotation driving device 300 may be located inside the support 200. However, the rotation driving device 300 may also be located outside the station 3 to transmit a rotational force to the support 200.

The rotation driving device 300 may include a driving motor 330 disposed at one of the first support 210 and the second support 220 and configured to generate a rotational force. The driving motor 330 may include a rotary shaft 331 configured to transmit the rotational force to the second support 220.

The rotation driving device 300 may include a first gear 310 connected to the driving motor 330 and receiving the rotational force from the driving motor 330. For example, the first gear 310 may include a shaft coupler 311 rotatably coupled to the rotary shaft 331 of the driving motor 330. The first gear 310 may be located at the other of the first support 210 and the second support 220.

The rotation driving device 300 may include a second gear 320 provided to be engaged with the first gear 310. A bearing 322 may be located at the center 321 of the second gear 320 for smooth rotation of the rotation driving device 300. The bearing 322 may reduce a frictional force between the first support 210 and the second support 220. The bearing 322 may be provided for smooth rotation of the rotation driving device 300. The first gear 310 may rotate in a state of being engaged with the second gear 320. The second gear 320 may be located at the other of the first support 210 and the second support 220.

For example, in the case where the driving motor 330 is located at the second support 220, the first gear 310 and the second gear 320 may be located at the first support 210. In the case where the driving motor 330 is located at the first support 210, the first gear 310 and the second gear 320 may be located at the second support 220.

Figure 4:
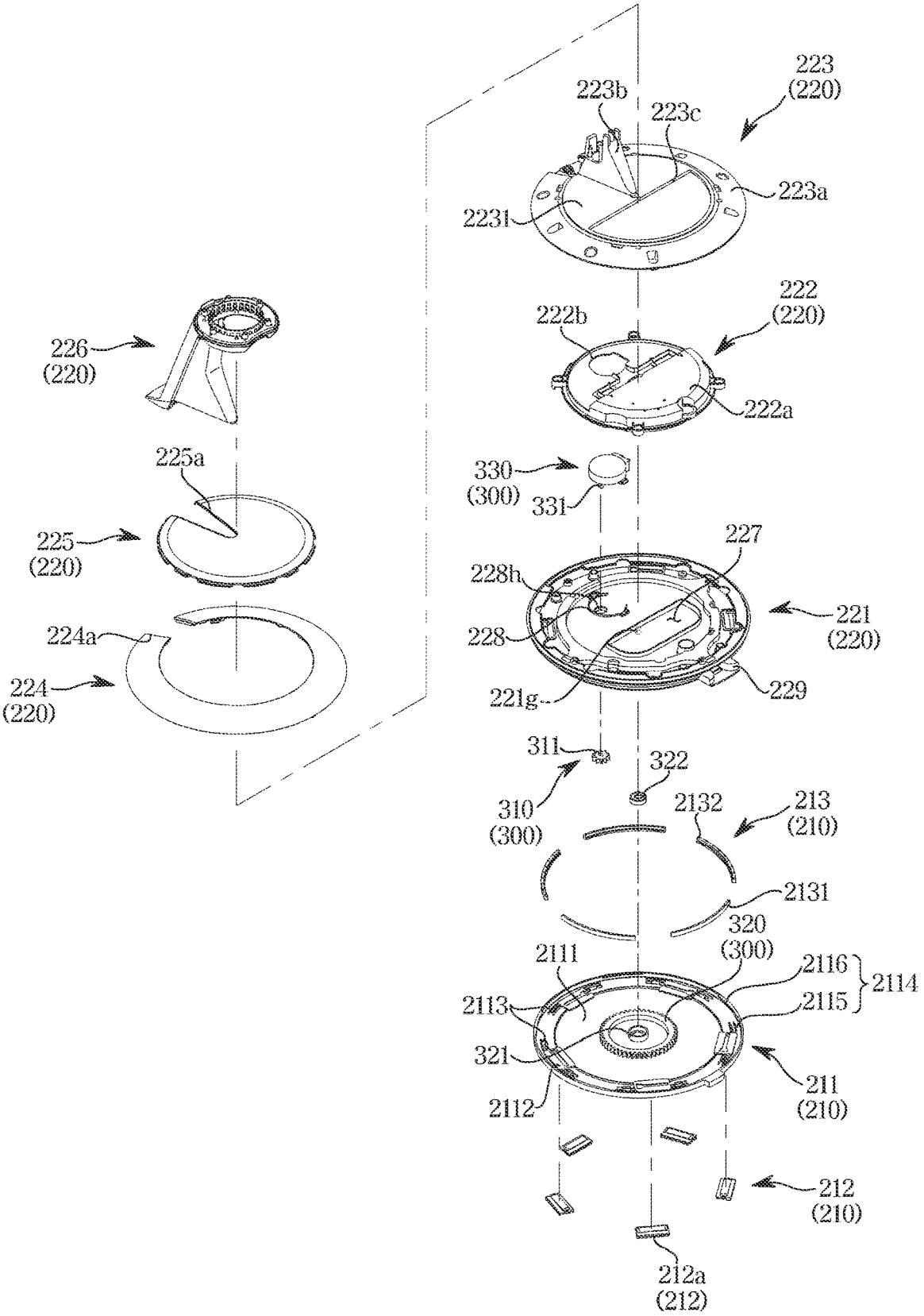
FIG. 4 illustrates an exploded view of a support according to an embodiment of the disclosure.
Figure 5:
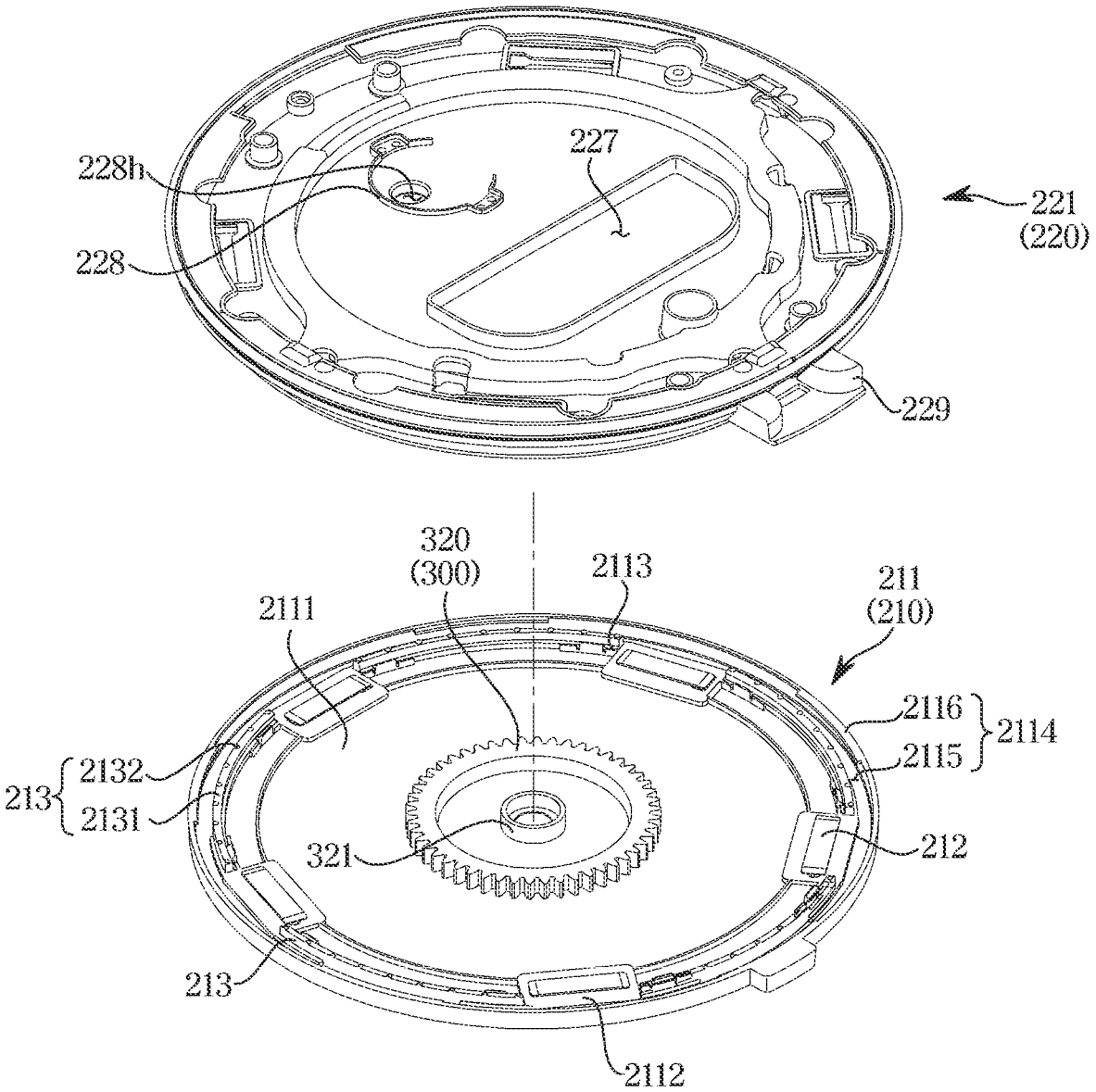
FIG. 5 illustrates a base and a rotation frame of the support shown in FIG. 4 according to an embodiment of the disclosure.
Figure 6:
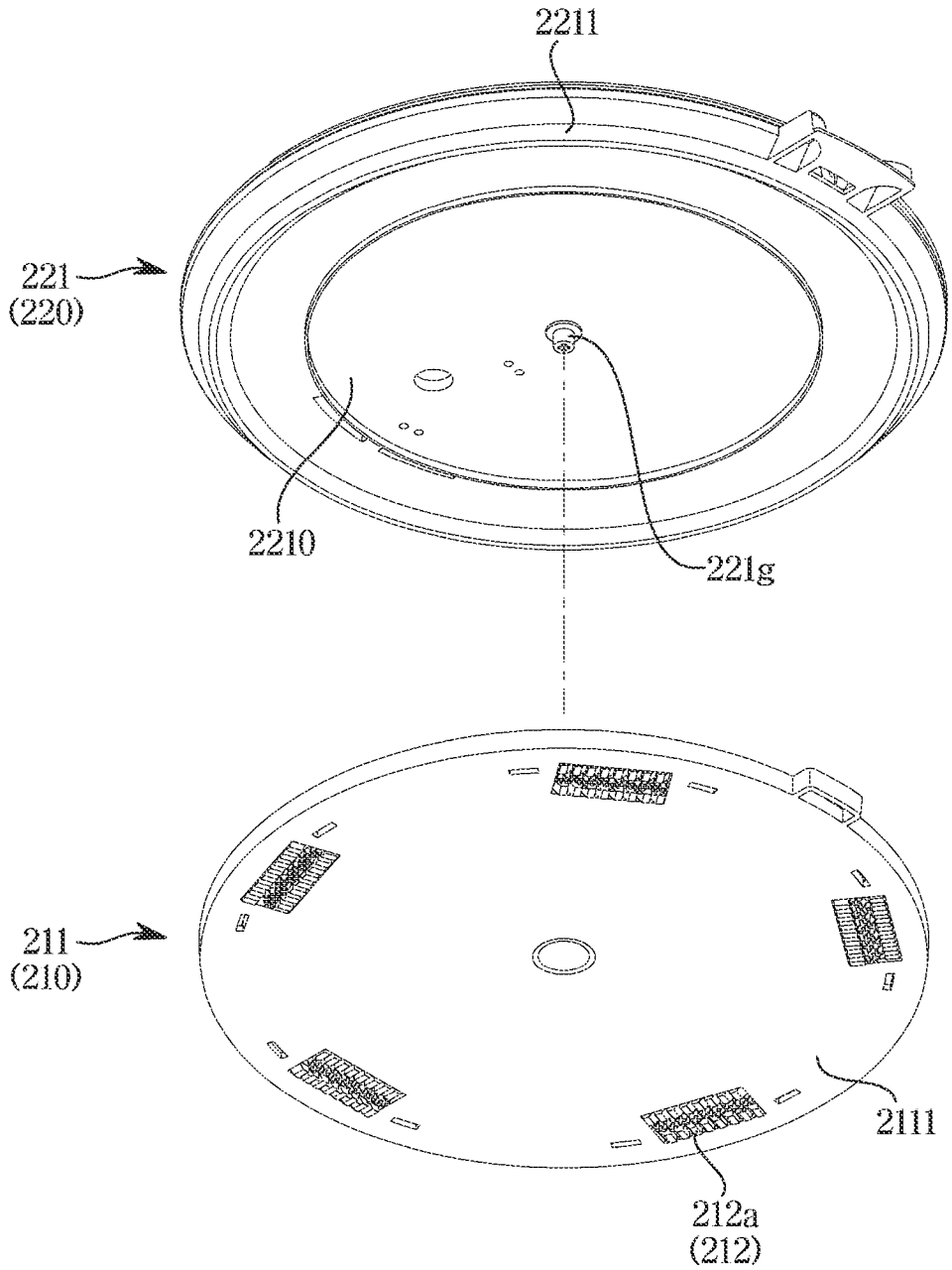
FIG. 6 illustrates the base and the rotation frame of the support shown in FIG. 5 viewed in a different direction according to an embodiment of the disclosure.
Figure 7:
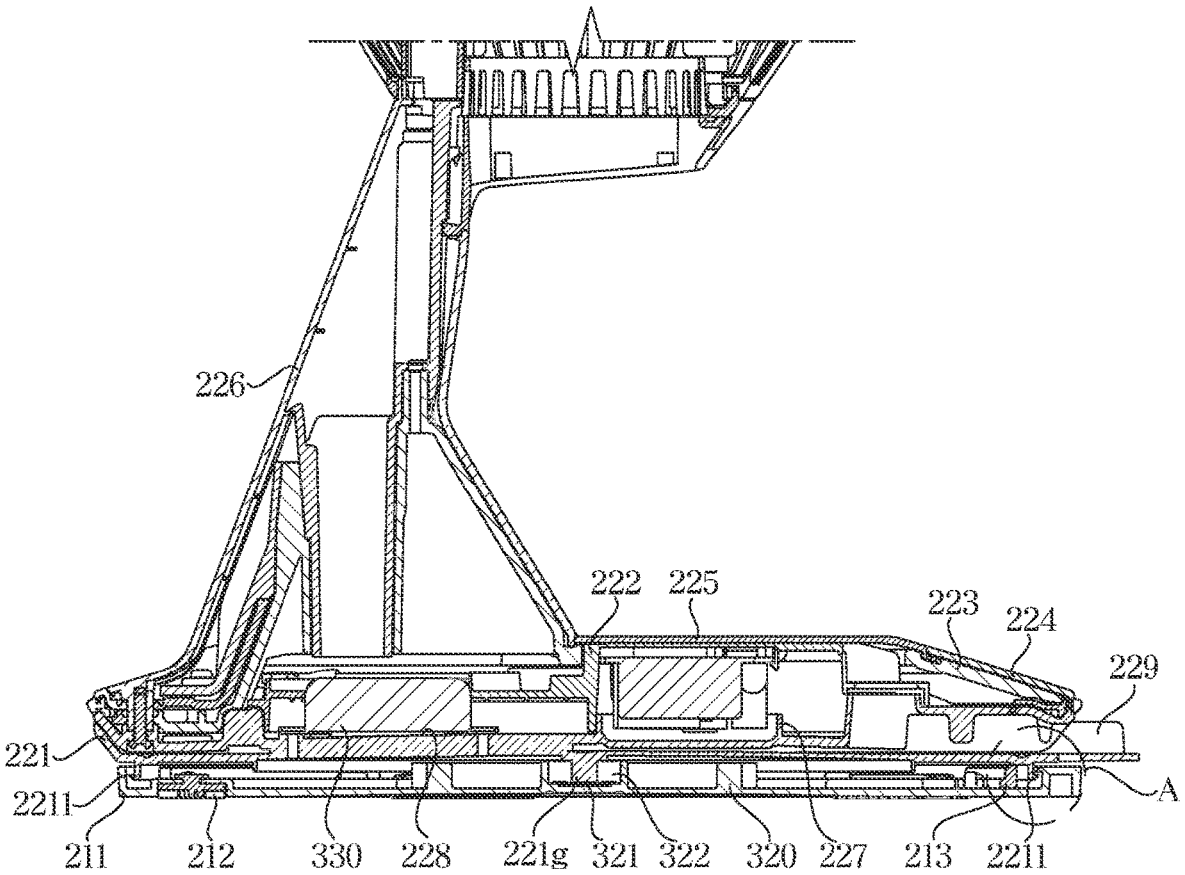
FIG. 7 is a side cross-section of the support shown in FIG. 4 according to an embodiment of the disclosure.
Figure 8:
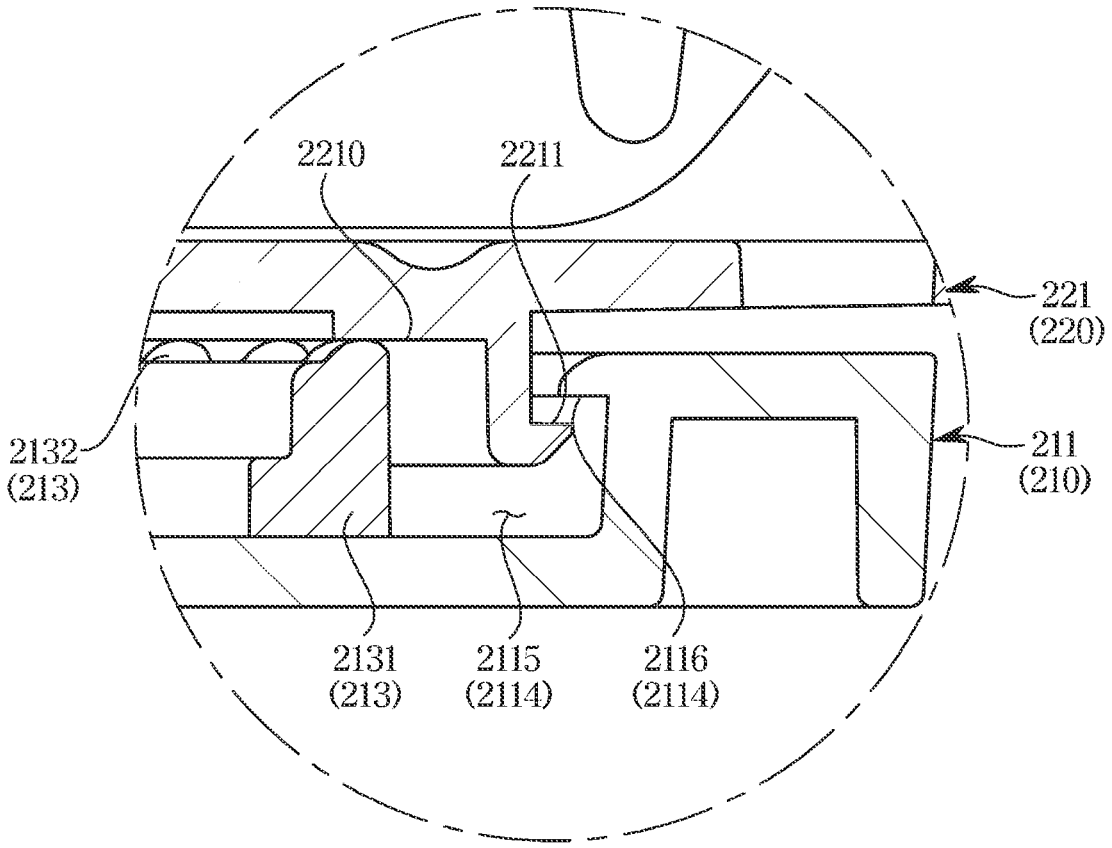
FIG. 8 illustrates an enlarged view of an area marked as A in FIG. 7 according to an embodiment of the disclosure.
Figure 9:
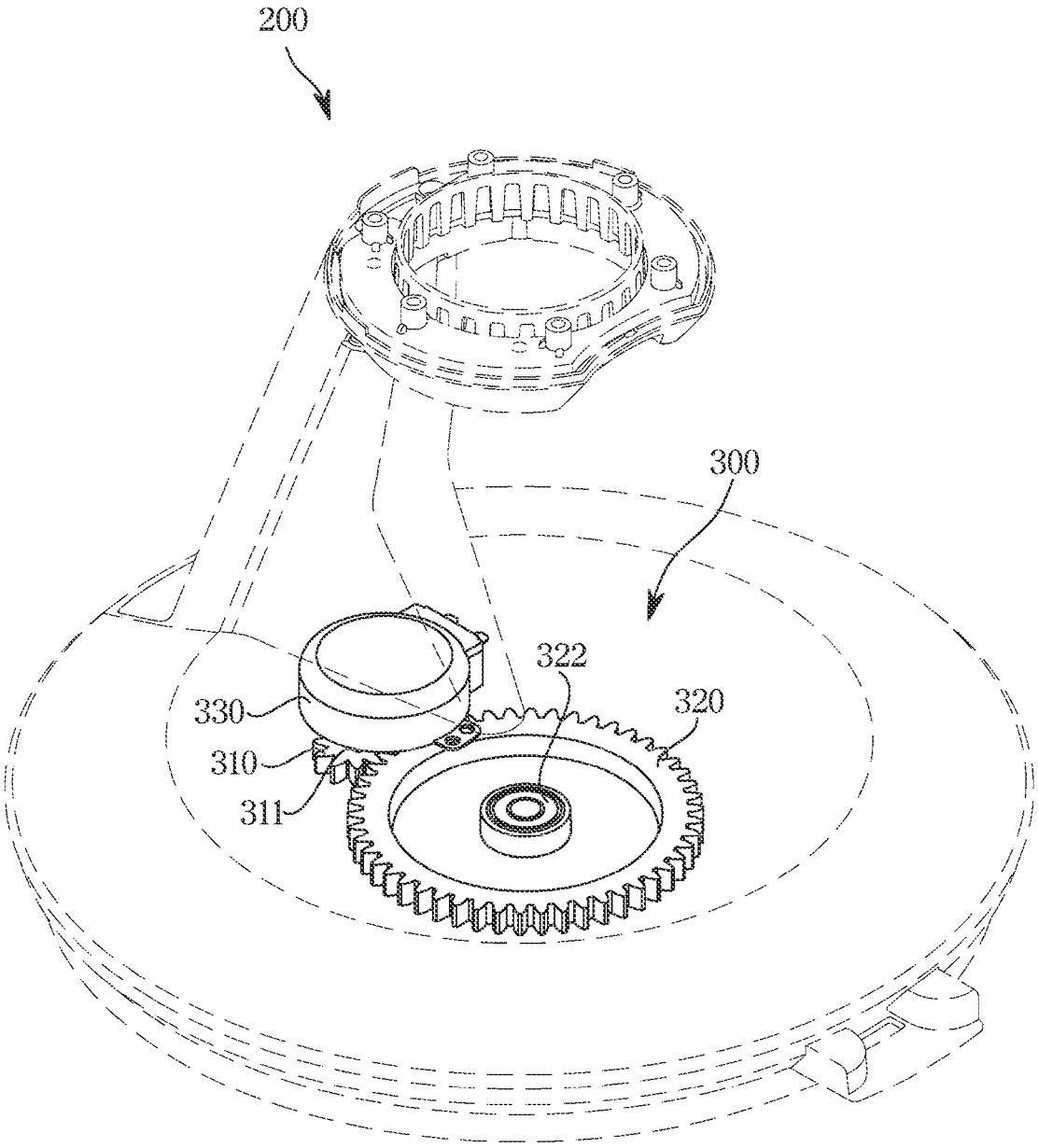
FIG. 9 illustrates a rotation driving device according to an embodiment of the disclosure.

FIG. 4 illustrates an exploded view of a support according to an embodiment of the disclosure. FIG. 5 illustrates a base and a rotation frame of the support shown in FIG. 4 according to an embodiment of the disclosure. FIG. 6 illustrates the base and the rotation frame of the support shown in FIG. 5 viewed in a different direction according to an embodiment of the disclosure. FIG. 7 is a side cross-section of the support shown in FIG. 4 according to an embodiment of the disclosure. FIG. 8 illustrates an enlarged view of an area marked as A in FIG. 7 according to an embodiment of the disclosure. FIG. 9 illustrates a rotation driving device according to an embodiment of the disclosure.

Referring to FIGS. 4 to 9, an example of the support 200 will be described. In this regard, the driving motor 330 may be located at the second support 220 and the first gear 310 and the second gear 320 may be located at the first support 210.

The first support 210 may include a base 211 and a support member 213. The first support 210 may further include a support pad 212.

The base 211 may include a body plate 2111.

A second gear 320 may be provided on the body plate 2111 of the base 211. The body plate 2111 and the second gear 320 may be integrated with each other. The first gear 310 may be located on the body plate 2111 to be engaged with the second gear 320.

The base 211 may include a rotation guide 2114 provided to guide rotation of a rotation frame 221, which will be described below. For example, the rotation guide 2114 may be formed at the periphery of the body plate 2111.

The rotation guide 2114 may include a recess 2115 in which a protrusion 2211 of the rotation frame 221, which will be described below, is rotatably accommodated, and a stopper 2116 provided to prevent dislocation of the protrusion 2211. The stopper 2116 may extend toward the protrusion 2211 from the recess 2115.

For example, while the first support 210 is coupled with the second support 220, the stopper 2116 may be located at an outer position in the radial direction than the protrusion 2211 and the stopper 2116 may extend inward in the radial direction. However, embodiments are not limited thereto. While the first support 210 is coupled with the second support 220, the stopper 2116 may also be located at an inner position in the radial direction than the protrusion 2211 and the stopper 2116 may extend outward the radial direction.

The base 211 may include a support mount 2113 on which the support member 213 is mounted. The support mount 2113 may be formed to correspond to the support member 213. For example, the support mount 2113 may protrude from the body plate 2111 to form a groove into which the support member 213 is inserted.

The base 211 may further include a pad mount 2112 on which the support pad 212 is mounted.

The support pad 212 may be provided on the pad mount 2112 of the base 211 to be in contact with the ground G. The support pad 212 may prevent the station 3 from sliding. The support pad 212 may include an uneven surface 212*a* at a position in contact with the ground G to increase a frictional force between the station 3 and the ground G. For example, the support pad 212 may include a material such as a synthetic resin or rubber.

The support member 213 may be provided to support rotation of the second support 220. The support member 213 may support a bottom surface 2210 of the second support 220 and may be provided to reduce a frictional force between the first support 210 and the second support 220. The support member 213 is used for smooth rotation of the second support 220 with respect to the first support 210. In addition, the support member 213 may distribute a load of the first support 210.

For example, the support member 213 may include a support body 2131 and a protrusion 2132 formed on the top surface of the support body 2131. The support member 213 may have an approximately arc shape and the protrusion 2132 may have an approximately dome shape. However, the support member 213 may be formed in various shapes capable of supporting the second support 220 and reducing the frictional force.

A plurality of support members 213 may be provided. In this case, the plurality of support members 213 may be arranged along the circumferential direction of the first support 210 to be spaced apart from each other.

However, the first support 210 may include at least one bearing member, instead of the support member 213, to support rotation of the second support 220. For example, a plurality of bearing members may be arranged along the circumferential direction of the first support 210 to be spaced apart from each other.

The second support 220 may include a rotation frame 221. The rotation frame 221 may be rotatably coupled to the first support 210.

The rotation frame 221 may include a protrusion 2211 extending downward from the bottom surface 2210. The protrusion 2211 may be rotatably accommodated in the recess 2115 of the base 211. The protrusion 2211 may be provided to be held by the stopper 2116 of the base 211 and thus dislocation thereof may be prevented. For example, the protrusion 2211 may have a hook shape.

The rotation frame 221 may include a gear coupler 221*g* coupled to the second gear 320. The gear coupler 221*g* may be provided to extend downward from the bottom surface 2210 to be coupled to the center 321 of the second gear 320. The bearing 322 may be coupled to the gear coupler 221*g*. The gear coupler 221*g* may be in approximately the form of a shaft.

The rotation frame 221 may include a circuit board holder 227 to hold a circuit board (not shown). However, this is merely an example, and the circuit board holder 227 may also be formed at a component other than the rotation frame 221. For example, the circuit board holder 227 may be formed at another component (e.g., a coupling frame 223) of the second support 220 or at the first support 210.

The rotation frame 221 may include a motor holder 228 to hold the driving motor 330. The motor holder 228 may have a hole 228*h* through which the rotary shaft 331 of the driving motor 330 passes. However, this is merely an example, and the motor holder 228 may also be formed at another component of the second support 220 or at the first support 210.

The rotation frame 221 may include a cable holder 229 to accommodate a cable (not shown) to receive the power from the outside. However, the embodiment is not limited thereto, and the cable holder 229 may also be located at another component of the second support 220 or at the first support 210.

The station 3 may receive the power from a battery (not shown) built therein without receiving the power from the outside. In this case, the cable holder 229 may be omitted.

The second support 220 may include a cover frame 222. For example, the cover frame 222 may include a cover 222*a* to cover the circuit board holder 227 and a motor mount 222*b* on which the driving motor 330 is mounted.

The second support 220 may include the coupling frame 223 for coupling of components of the support 200. For example, the coupling frame 223 may include a body 2231, a first coupler 223*a*, a second coupler 223*b*, and a third coupler 223*c*. The first coupler 223*a* may be provided to be coupled with the rotation frame 221, the second coupler 223*b* may be provided to be coupled with a support frame 226, which will be described below, and the third coupler 223*c* may be provided to be coupled with the cover frame 222.

The second support 220 may include a top frame 225 and a side frame 224 coupled to an edge of the top frame 225. The side frame 224 may have an approximately hollow annular shape. Each of the top frame 225 and the side frame 224 may include incisions 225*a* and 224*a* respectively coupled to the support frame 226.

The second support 220 may include a support frame 226 provided to support a weight of the main body 100 of the station 3. The support frame 226 may be coupled with the top frame 225 and the side frame 224 to form the accommodation space 240 in which the suction head 13 is accommodated.

Figure 10:
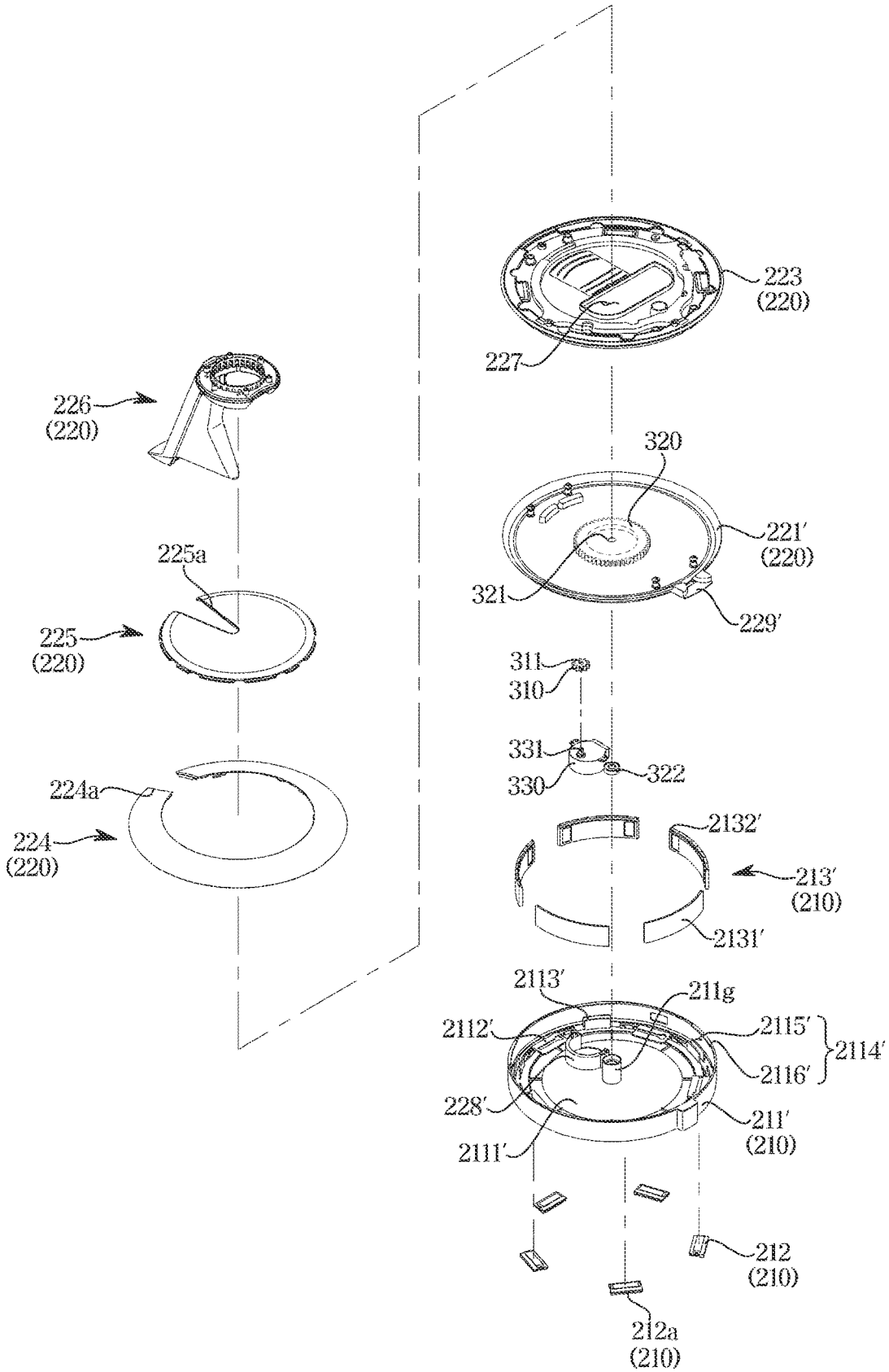
FIG. 10 illustrates an exploded view of a support according to an embodiment of the disclosure.
Figure 11:
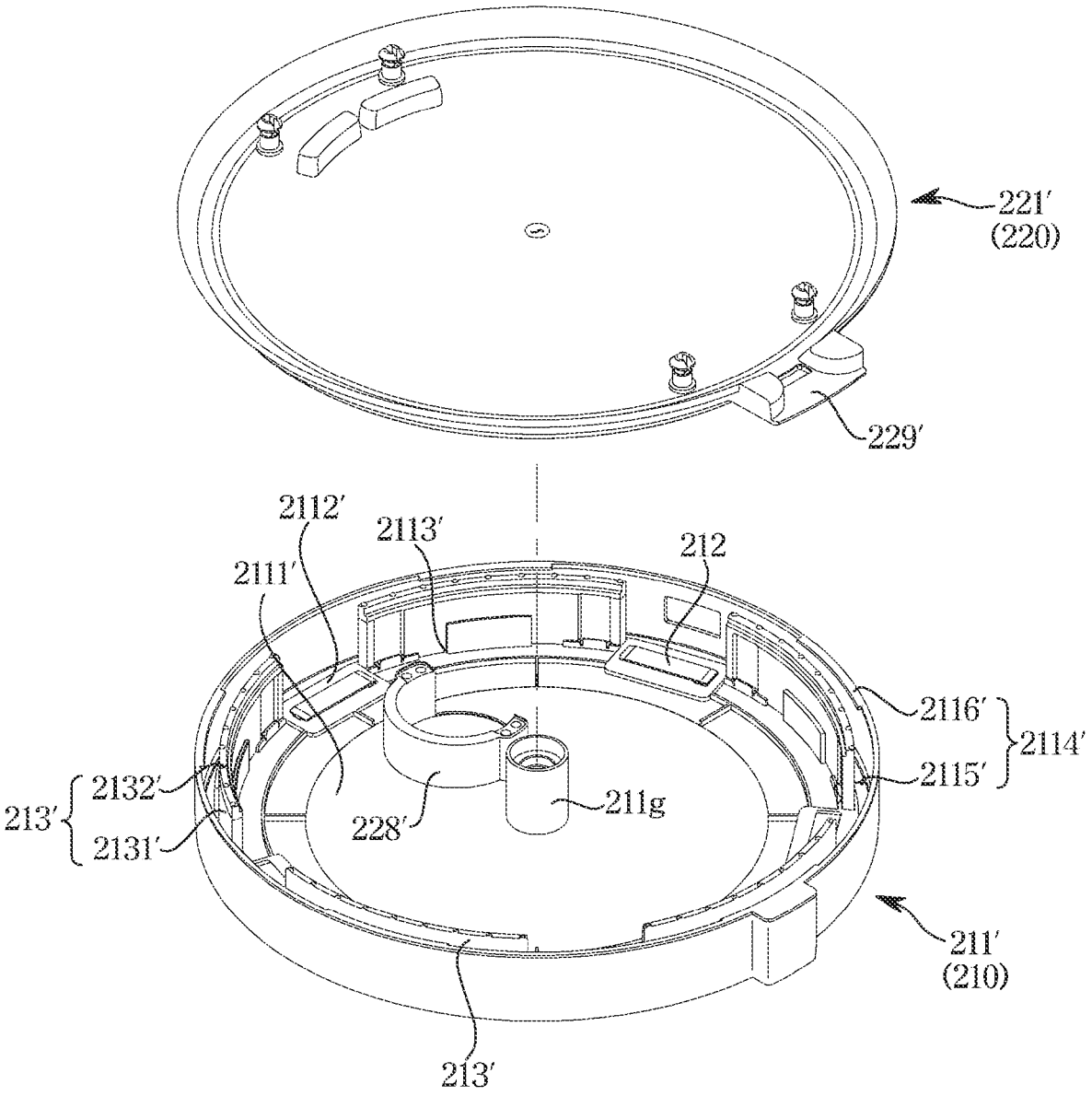
FIG. 11 illustrates a base and a rotation frame of the support shown in FIG. 10 according to an embodiment of the disclosure.
Figure 12:
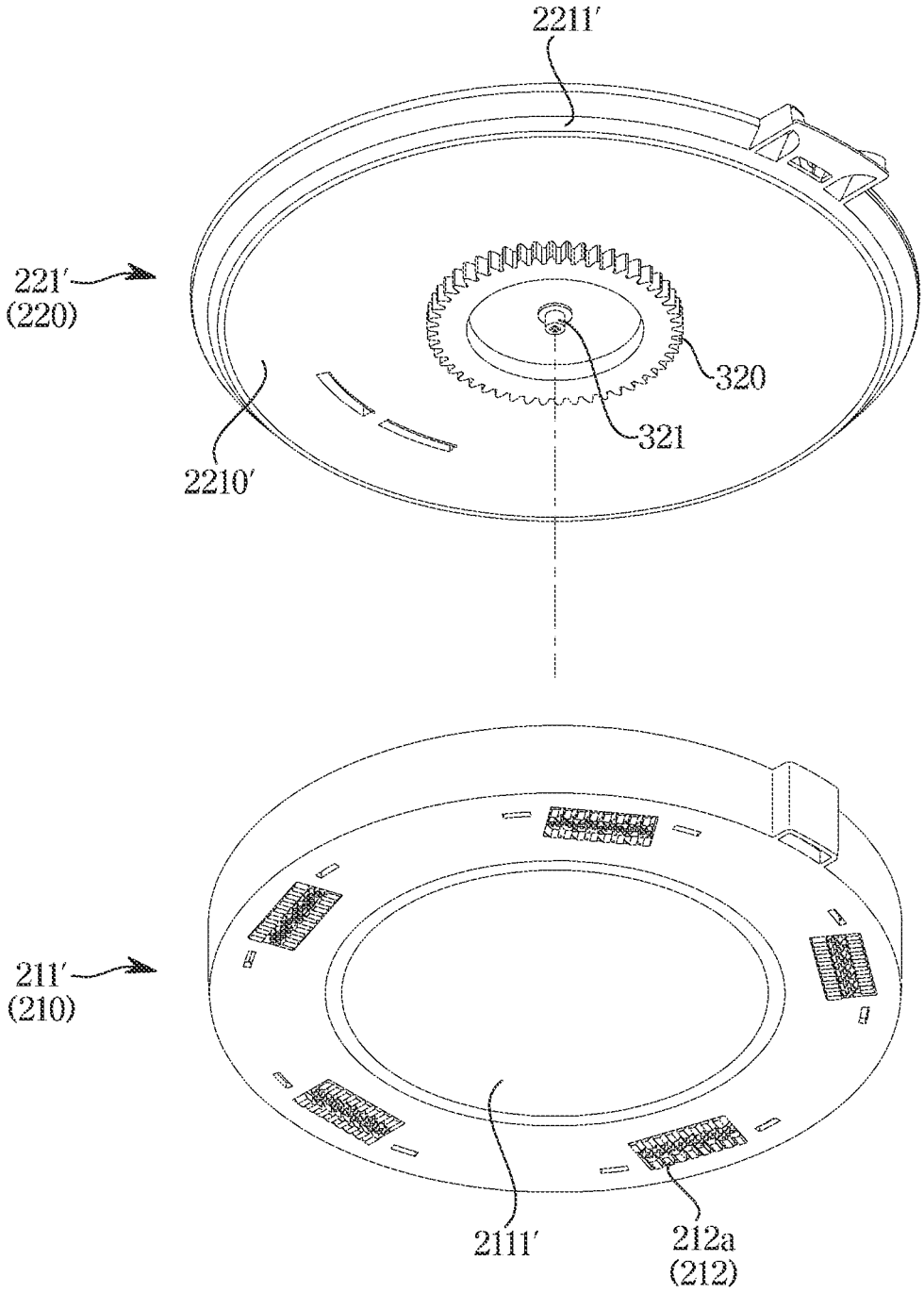
FIG. 12 illustrates the base and the rotation frame of the support shown in FIG. 11 viewed in a different direction according to an embodiment of the disclosure.
Figure 13:
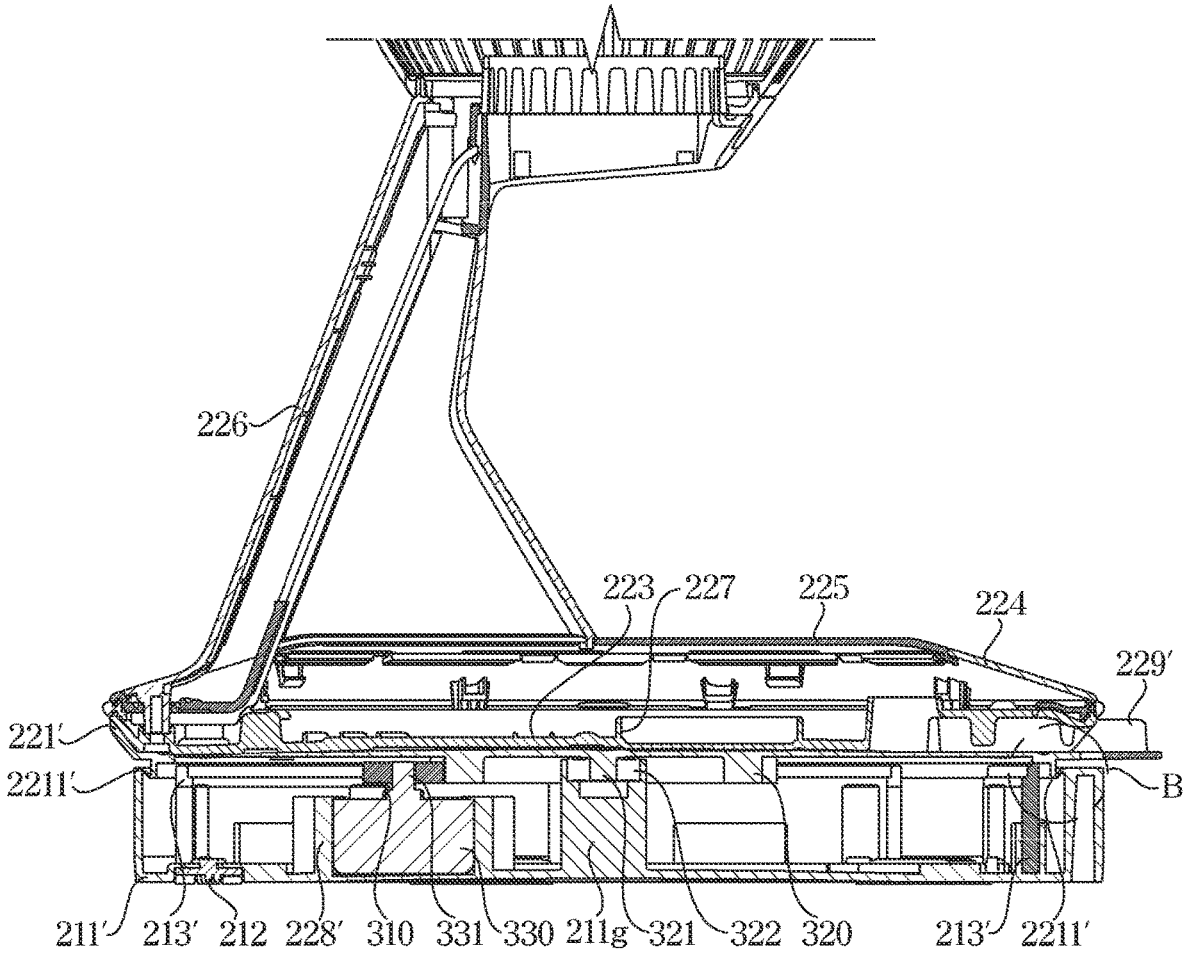
FIG. 13 is a side cross-section of the support shown in FIG. 10 according to an embodiment of the disclosure.
Figure 14:
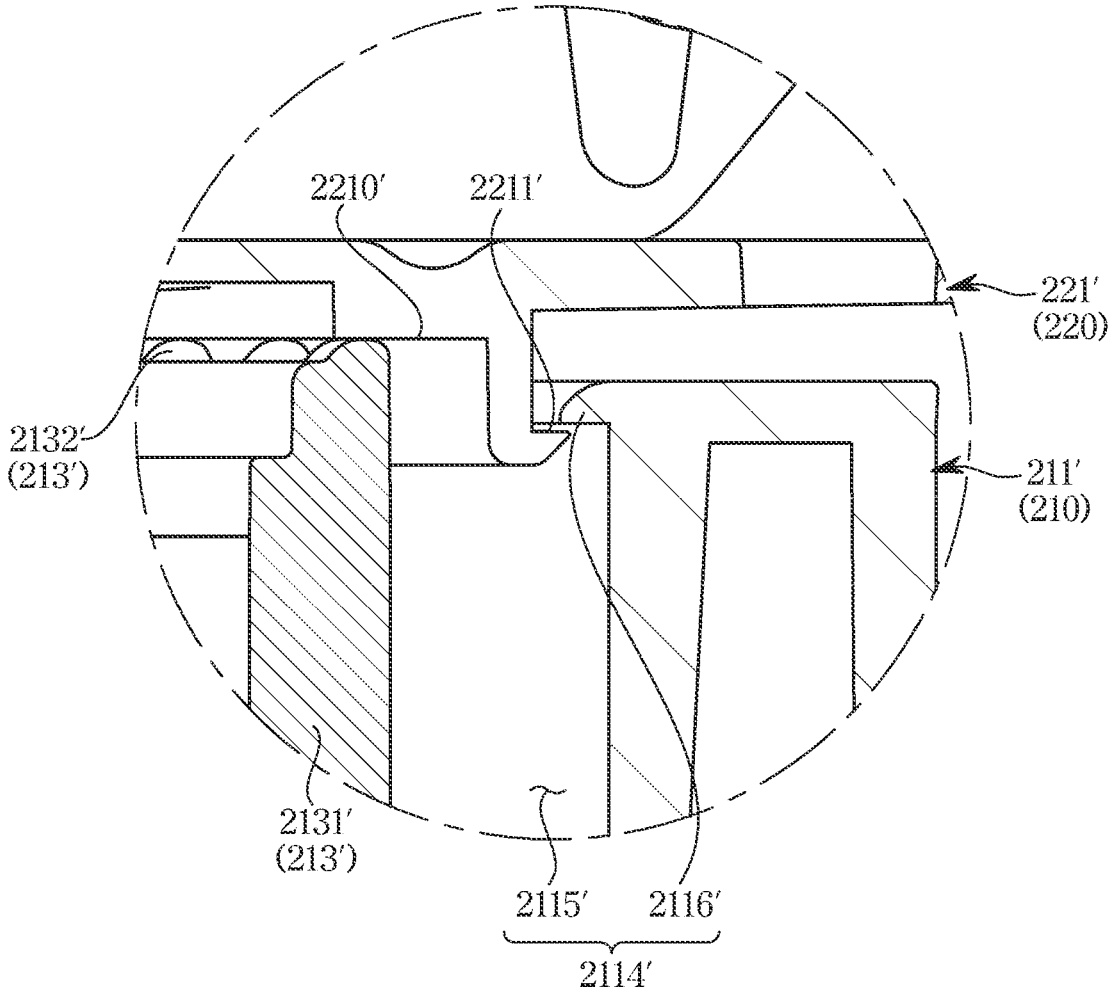
FIG. 14 illustrates an enlarged view of an area marked as B in FIG. 13 according to an embodiment of the disclosure.
Figure 15:
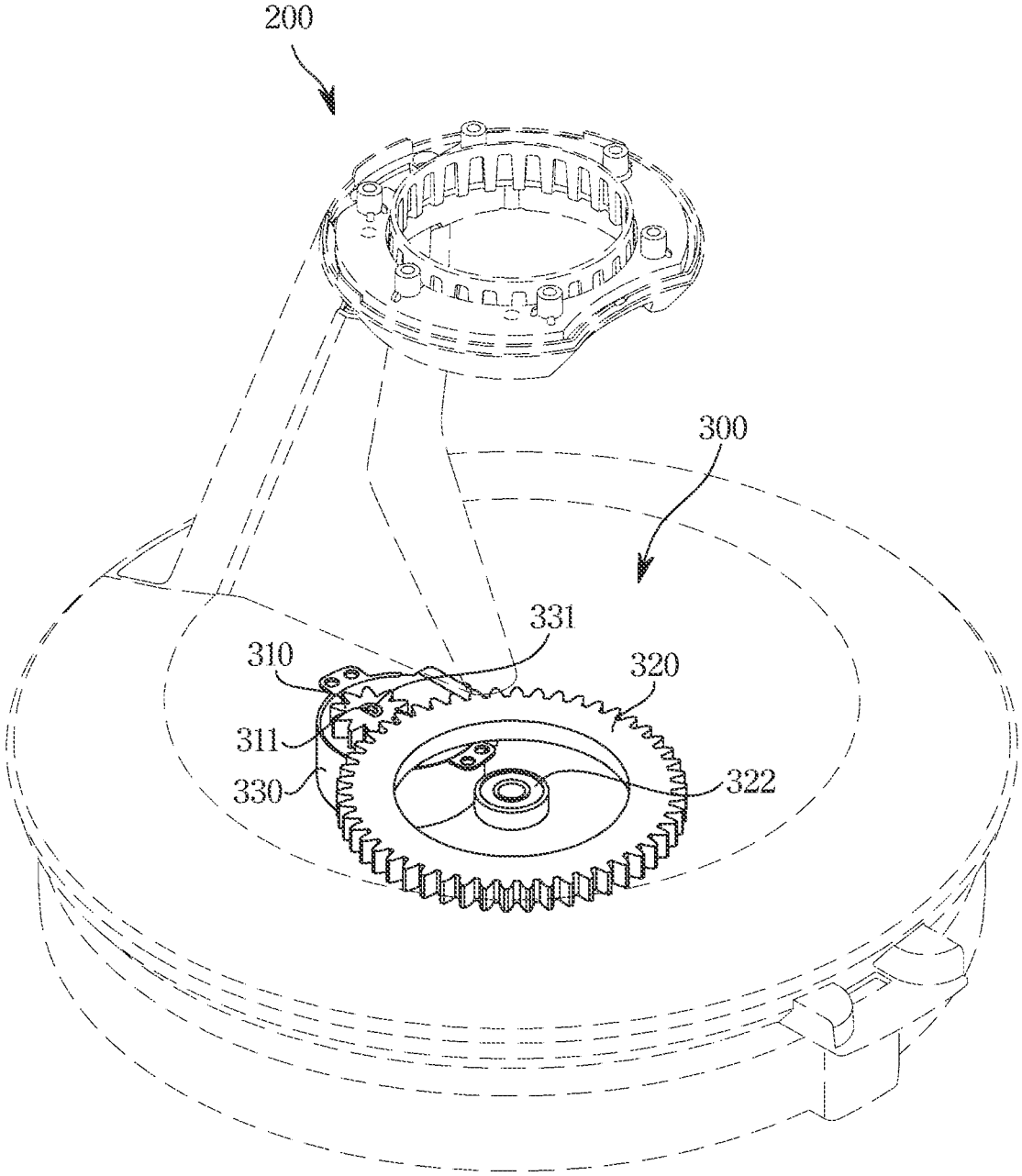
FIG. 15 illustrates a rotation driving device according to an embodiment of the disclosure.

FIG. 10 illustrates an exploded view of a support according to an embodiment of the disclosure. FIG. 11 illustrates a base and a rotation frame of the support shown in FIG. 10 according to an embodiment of the disclosure. FIG. 12 illustrates the base and the rotation frame of the support shown in FIG. 11 viewed in a different direction according to an embodiment of the disclosure. FIG. 13 is a side cross-section of the support shown in FIG. 10 according to an embodiment of the disclosure. FIG. 14 illustrates an enlarged view of an area marked as B in FIG. 13 according to an embodiment of the disclosure. FIG. 15 illustrates a rotation driving device according to an embodiment of the disclosure.

Referring to FIGS. 10 to 15, another example of the support 200 will be described. In this regard, the driving motor 330 may be located at the first support 210 and the first gear 310 and the second gear 320 may be located at the second support 220. Meanwhile, like reference numerals or symbols denote like elements or components performing the substantially same function, and detailed descriptions thereof will be omitted.

The first support 210 may include a base 211' and a support member 213'. The first support 210 may further include the support pad 212.

The base 211' may include a body plate 2111'.

A driving motor 330 may be seated on the body plate 2111' of the base 211'. For example, the body plate 2111' may include a motor holder 228'. In addition, the body plate 2111' may include a gear coupler 211*g* coupled to the center 321 of the second gear 320. The bearing 322 may be coupled to the gear coupler 211*g*.

The base 211' may include a rotation guide 2114' provided to guide rotation of a rotation frame 221' of the second support 220. For example, the rotation guide 2114' may be formed at the periphery of the body plate 2111'.

The rotation guide 2114' may include a recess 2115' in which a protrusion 2211' of the rotation frame 221' is rotatably accommodated and a stopper 2116' provided to prevent dislocation of the protrusion 2211'. The stopper 2116' may extend toward the protrusion 2211' from the recess 2115'.

For example, while the first support 210 is coupled with the second support 220, the stopper 2116' may be located at an outer position than the protrusion 2211' in the radial direction and the stopper 2116' may extend inward in the radial direction. However, the embodiment is not limited thereto. While the first support 210 is coupled with the second support 220, the stopper 2116' may also be located at an inner position than the protrusion 2211' in the radial direction and the stopper 2116' may extend outward in the radial direction.

The base 211' may include a support mount 2113' on which the support member 213' is mounted. The support mount 2113' may be formed to correspond to the support member 213'. For example, the support mount 2113' may protrude from the body plate 2111' to form a groove into which the support member 213' is inserted.

The base 211' may further include a pad mount 2112' on which the support pad 212 is mounted.

The support member 213' may be provided to support rotation of the second support 220. The support member 213' may be provided to support the bottom surface 2210' of the second support 220 and reduce a frictional force between the first support 210 and the second support 220. The support member 213' is used for smooth rotation of the second support 220 with respect to the first support 210. In addition, the support member 213' may distribute a weight of the first support 210.

For example, the support member 213' may include a support body 2131' and a protrusion 2132' formed on the top surface of the support body 2131'. The support member 213' may have an approximately arc shape and the protrusion 2132' may have an approximately dome shape. However, embodiments are not limited to these shapes, and the support member 213' may be formed in various shapes capable of supporting the second support 220 and reducing the frictional force.

A plurality of support members 213' may be provided. The plurality of support members 213' may be arranged along the circumferential direction of the first support 210 to be spaced apart from each other.

However, the first support 210 may include at least one bearing member, instead of the support member 213', to support rotation of the second support 220. For example, a plurality of bearing members may be arranged along the circumferential direction of the first support 210 to be spaced apart from each other.

The second support 220 may include a rotation frame 221'. The rotation frame 221' may be rotatably coupled to the first support 210.

The rotation frame 221' may include a protrusion 2211' extending downward from the bottom surface 2210'. The protrusion 2211' may be rotatably accommodated in the recess 2115' of the base 211'. The protrusion 2211' may be provided to be caught by the stopper 2116' of the base 211' and dislocation thereof may be prevented. For example, the protrusion 2211' may have a hook shape.

The rotation frame 221' may include a cable holder 229' to accommodate a cable (not shown) to receive the power from the outside. However, embodiments are not limited thereto, and the cable holder 229' may also be located at another component of the second support 220 or at the first support 210.

The station 3 may receive the power from a battery (not shown) built therein without receiving the power from the outside. In this case, the cable holder 229 may be omitted.

Figure 16:
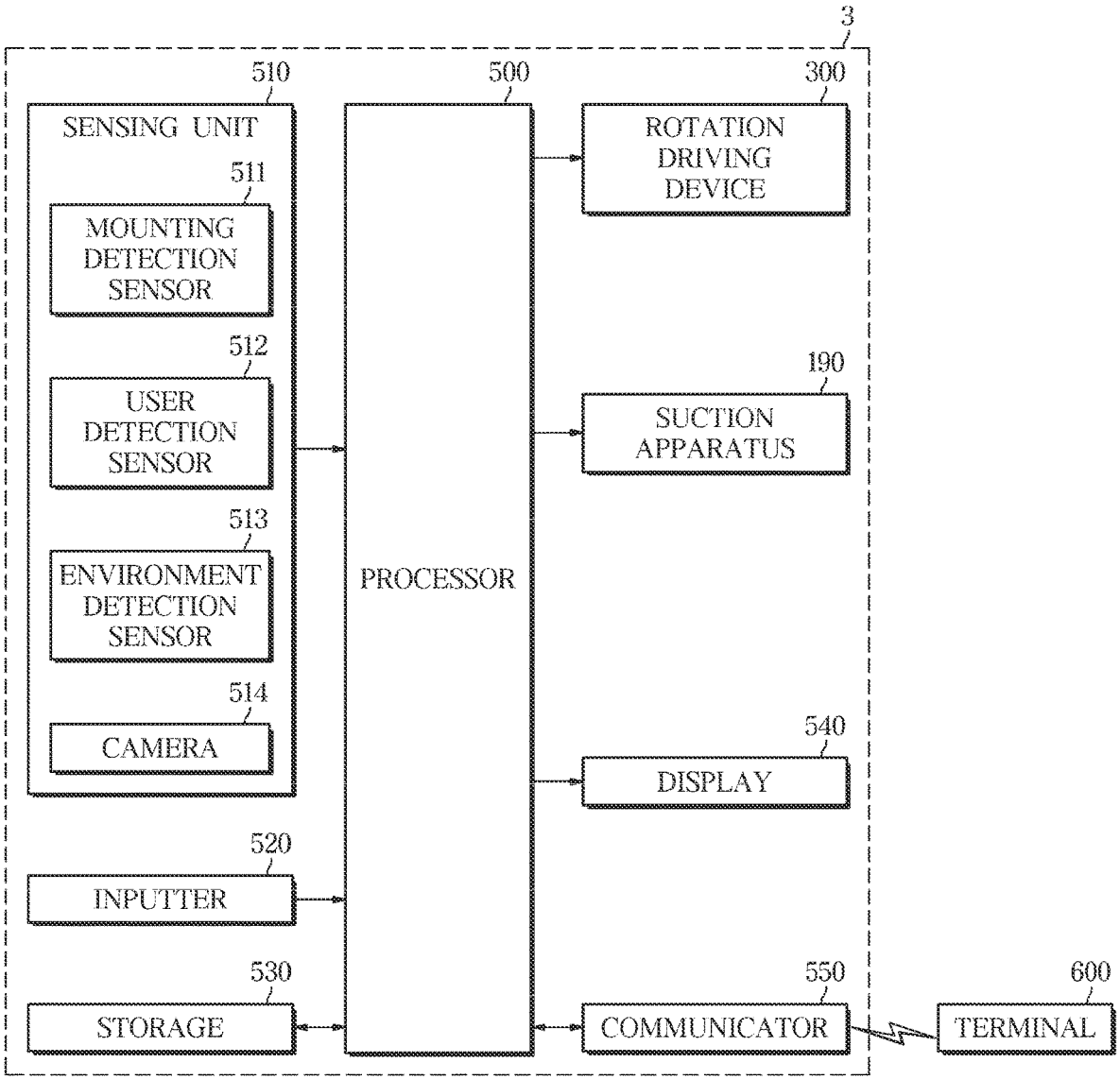
FIG. 16 is a control block diagram of a station according to an embodiment of the disclosure.

FIG. 16 is a control block diagram of a station according to an embodiment of the disclosure.

Referring to FIG. 16, the station 3 may include a sensing unit 510, an inputter 520, a storage 530, a processor 500, a rotation driving device 300, a suction apparatus 190, a display 540, and a communicator 550.

However, each of the components of the station 3 illustrated in FIG. 16 may be omitted according to embodiments, and any other component not illustrated in FIG. 16 may also be included according to embodiments.

The sensing unit 510 may detect various states of the station 3.

The sensing unit 510 may include a mounting detection sensor 511 configured to detect whether the cleaner 2 is mounted on the station 3, a user detection sensor 512 configured to detect a user present at a preset distance from the station 3, an environment detection sensor 513 configured to sense an environment surrounding the station 3, and a camera 514 configured to obtain images in the forward direction of the station 3.

The mounting detection sensor 511 may detect whether the cleaner 2 is mounted on the station 3 as described above. The mounting detection sensor 511 may transmit a signal corresponding to mounting of the cleaner 2 to the processor 500 in the case where the cleaner 2 is mounted on the station 3, and may transmit a signal corresponding to separation of the cleaner 2 to the processor 500 in the case where the cleaner 2 is separated from the station 3.

For example, the mounting detection sensor 511 may be a piezoelectric sensor that is pressed by the cleaner 2 to output an electrical signal in the case where the cleaner 2 is mounted on the station 3. However, the type of the mounting detection sensor 511 is not limited, as long as the mounting detection sensor 511 outputs an electrical signal when pressed.

In addition, the mounting detection sensor 511 may be a current sensor or a voltage sensor configured to detect electrical communication between the cleaner 2 and the station 3. The mounting detection sensor 511 may be a sensor capable of detecting electrical communication between the charging terminal 170 and the battery 16 of the cleaner 2.

The mounting detection sensor 511 may be a non-contact sensor of any known type such as an infrared sensor capable of recognizing the shape of the cleaner 2 in the case where the cleaner 2 is mounted on the station 3.

The user detection sensor 512 may identify a user present within a preset distance. To this end, the user detection sensor 512 may be an object detection sensor of any known type, for example, a non-contact type sensor such as an infrared sensor. The user detection sensor 512 may identify the user within a preset distance from the station 3 and transmit an identification signal about the identified user to the processor 500.

The environment detection sensor 513 may be a sensor capable of detecting an environment of an indoor space, such as a dust sensor capable of measuring an indoor dust concentration and a temperature sensor capable of measuring an indoor temperature, and detection results measured by the environment detection sensor 513 may be displayed on the display 540 under the control of the processor 500.

The camera 514 may be an image sensor of any known type and may be provided at a front surface of the station 3 to obtain an image of an indoor space, and the image obtained by the camera 514 may be transmitted to a user terminal (e.g., smartphone) 600 via the communicator 550 under the control of the processor 500.

The inputter 520 may receive an input from a user and may be provided as an input device of any known type. For example, the inputter 520 may include an input button provided at the main body 100 of the station 3 or a control panel provided at the main body 100 of the station 3. In this regard, the control panel may be a touch panel integrated with the display 540.

The storage 530 may store various information required to control the station 3. To this end, the storage 530 may be provided as a storage medium of any known type.

The processor 500 may control rotation of the support 200 based on information obtained by the sensing unit 510.

In response to separation of the cleaner 2 from the station 3, the processor 500 may control the rotation driving device 300 to rotate the support 200, thereby locating the extension tube guides 112*b* and 114*b* to face the forward direction of the main body 100 of the station 3.

Upon receiving a signal corresponding to separation of the cleaner 2 from the mounting detection sensor 511, the processor 500 may control the rotation driving device 300 to rotate the support 200, thereby locating the extension tube guides 112*b* and 114*b* to face the forward direction of the main body 100 of the station 3.

In this regard, after a lapse of a preset time from separation of the cleaner 2 from the station 3, the processor 500 may control the rotation driving device 300. After a lapse of a preset time from the separation of the cleaner 2 from the station 3, the processor 500 may control the rotation driving device 300 to rotate the support 200, thereby locating the extension tube guides 112*b* and 114*b* to face the forward direction of the main body 100 of the station 3.

In addition, upon detection of the user present within a preset distance from the station 3 in a state where the cleaner 2 is mounted on the station 3, the processor 500 may control the rotation driving device 300 to rotate the support 200, thereby locating the extension tube 12 of the cleaner 2 at the front of the main body 100 of the station 3.

Upon receiving an identification signal of a user present within a preset distance from the station 3 from the user detection sensor 512 in a state where a signal corresponding to mounting of the cleaner 2 is received from the mounting detection sensor 511, the processor 500 may control the rotation driving device 300 to rotate the support 200, thereby locating the extension tube 12 of the cleaner 2 at the front of the main body 100 of the station 3.

In the case where a signal corresponding to separation of the cleaner 2 is not received from the mounting detection sensor 511 for a preset period of time after the support 200 rotates, the processor 500 may control the rotation driving device 300 to rotate the support 200, thereby locating the extension tube 12 of the cleaner 2 at the rear of the main body 100 of the station 3.

In addition, in response to mounting of the station 3 on the station 3 after the cleaner 2 is separated from the station 3, the processor 500 may control the rotation driving device 300 to rotate the support 200, thereby locating the extension tube 12 of the cleaner 2 at the rear of the main body 100 of the station 3.

Upon receiving a signal corresponding to mounting of the cleaner 2 from the mounting detection sensor 511, the processor 500 may control the rotation driving device 300 to rotate the support 200, thereby locating the extension tube 12 of the cleaner 2 at the rear of the main body 100 of the station 3.

In addition, in response to separation of the cleaner 2 from the station 3 while the rotation driving device 300 is controlled in a state where the cleaner 2 is mounted on the station 3, the processor 500 may stop the rotation driving device 300.

The processor 500 may control the rotation driving device 300 based on an output of a sensor configured to detect a position of the support 200 (e.g., hole sensor). For example, in the case where the support 200 is located at a position corresponding to the case where the extension tube 12 of the cleaner 2 is located at the front of the main body 100 of the station 3, the processor 500 may not control the rotation driving device 300 even when the cleaner 2 is separated. Also, in the case where the support 200 is located at a position corresponding to the case where the extension tube 12 of the cleaner 2 is located at the front of the main body 100 of the station 3, the processor 500 may not control the rotation driving device 300 even when the identification signal of the user present within the preset distance is received from the station 3. In the case where the support 200 is located at a position corresponding to the case where the extension tube guides 112*b* and 114*b* are located at the rear of the main body 100 of the station 3, the processor 500 may not control the rotation driving device 300 even when the signal corresponding to the mounting of the cleaner 2 is received in a state where the cleaner 2 is separated.

In addition, the processor 500 may set at least one of an On/Off of rotation of the support 200, a rotation range of the support 200, a rotation direction of the support 200, and a rotational speed of the support 200, based on a user input received via the inputter 520.

In addition, the processor 500 may determine whether to activate the operation of controlling the rotation of the support 200 or not based on the user input received via the inputter 520.

The rotation driving device 300 is provided to transmit the rotational force to the support 200 of the station 3. The rotation driving device 300 is described above in detail, and thus descriptions thereof will not be repeated hereinafter.

The suction apparatus 190 may generate a suction force to suck external air. For example, the suction apparatus 190 may include a suction duct (not shown) provided at the front of the housing 110 to suck air from the outside of the station 3. The suction duct may be connected to a flow path formed in the station 3. As the driving device 152 of the suction device 150 operates at a low speed, external air may be introduced into the station 3 through the suction duct. Foreign matter contained in the air introduced into the station 3 may be filtered out by the exhaust filter 160. Air from which the foreign matter is removed may be discharged out of the station 3. The station 3 may perform an air purification function.

The display 540 may be provided at the front of the housing 110 to display various information to the user. To this end, the display 540 may be provided as a display panel of any known type.

The communicator 550 may communicate with an external terminal 600 and may be provided as a wireless communication module of any known type therefor.

Figure 17A:
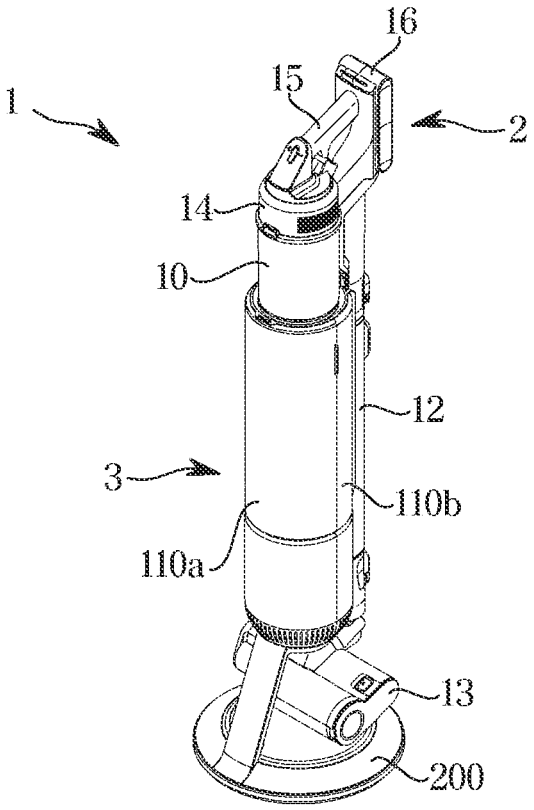
FIGS. 17A, 17B, and 17C are views for describing a rotation operation of a station in response to separation of a cleaner of a cleaning device from the station according to an embodiment of the disclosure.
Figure 17B:
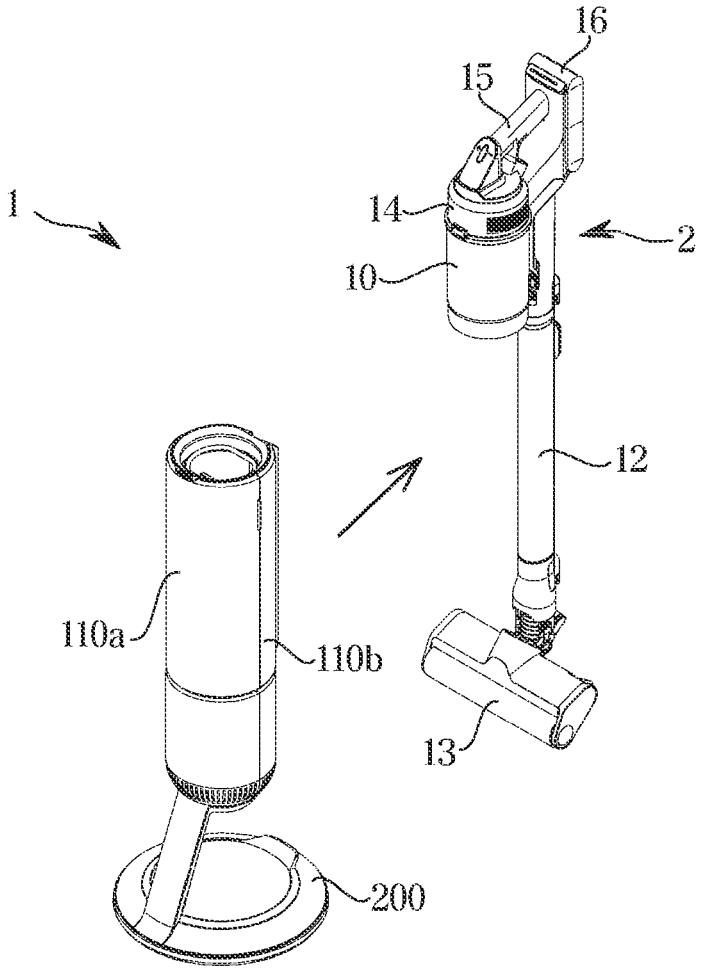
Figure 17C:
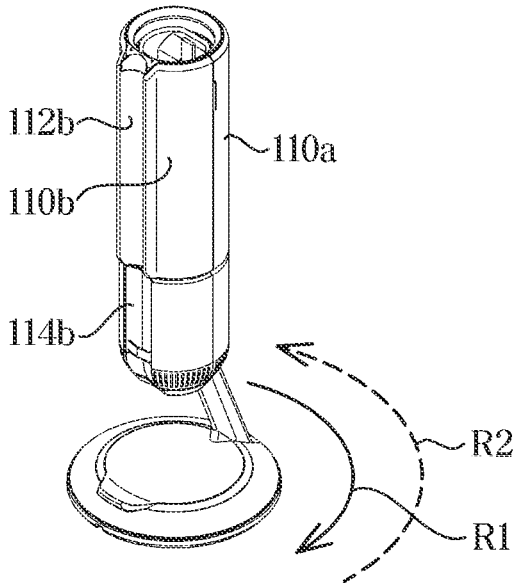
Figure 18A:
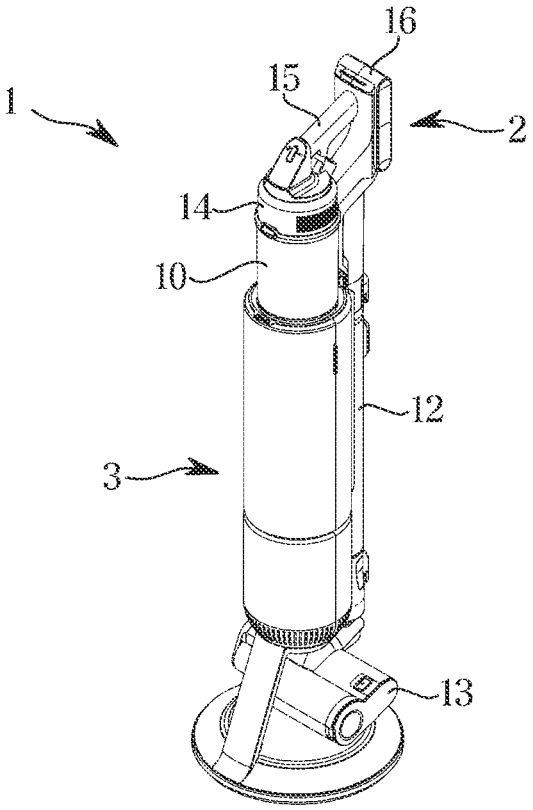
FIGS. 18A, 18B, 18C, and 18D are views for describing a rotation operation of a station in response to detection of a user present within a preset distance of a cleaning device according to an embodiment of the disclosure.
Figure 18B:
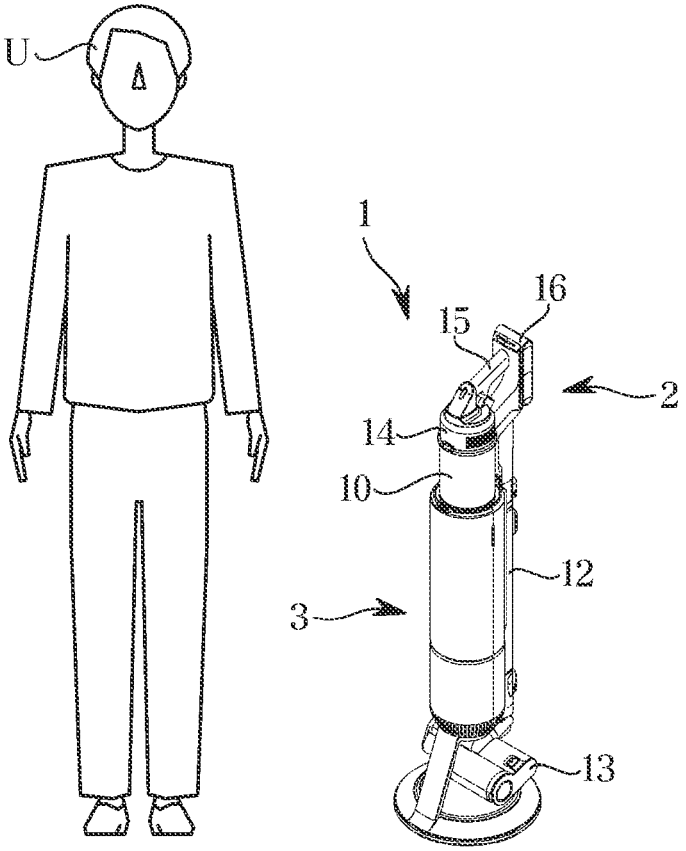
Figure 18C:
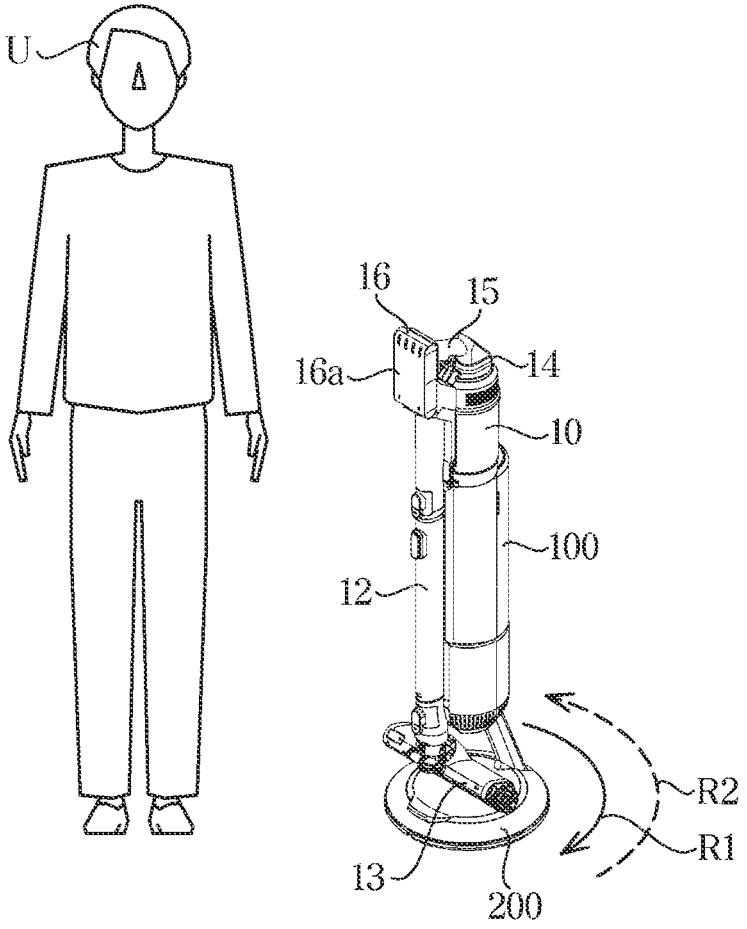
Figure 18D:
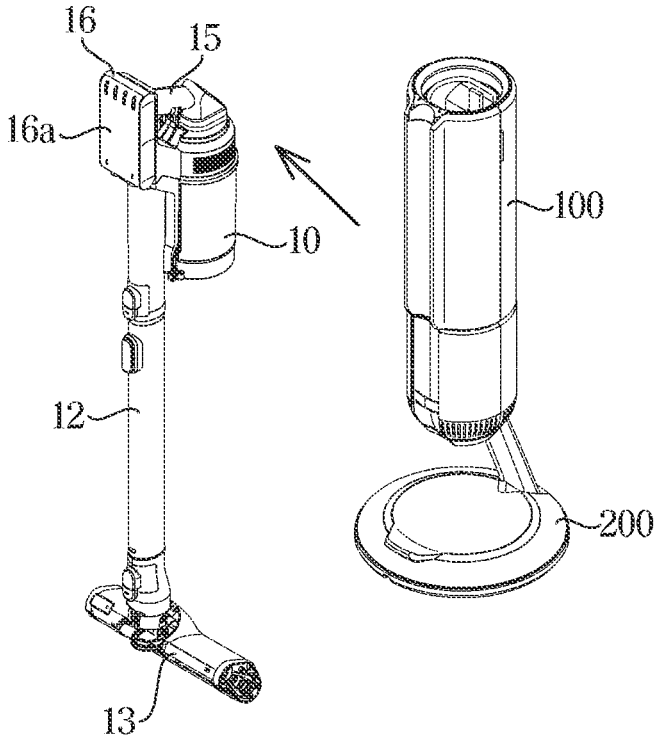
Figure 19A:
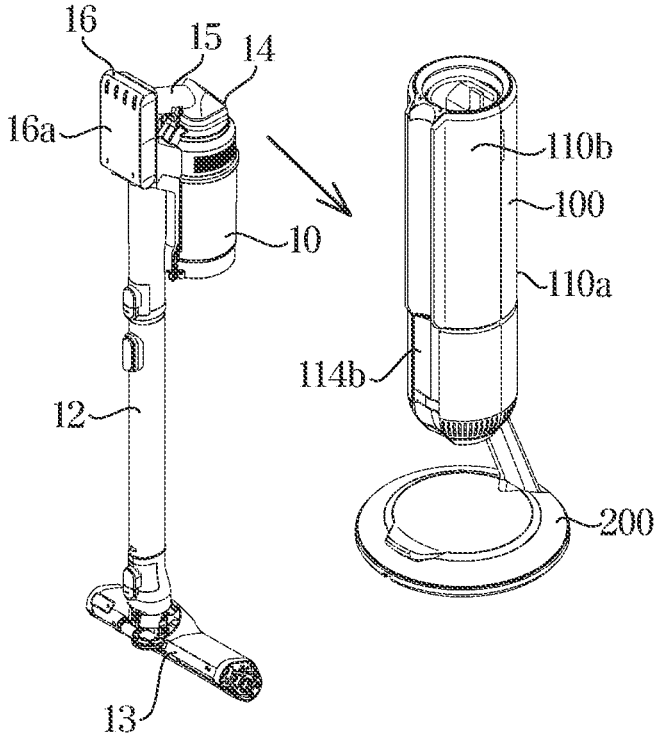
FIGS. 19A,19B, and 19C are views for describing a rotation operation of a station in response to mounting of a cleaner of a cleaning device on the station according to an embodiment of the disclosure.
Figure 19B:
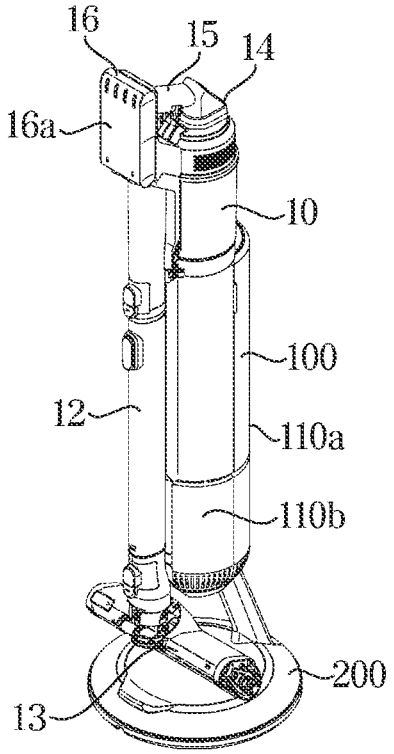
Figure 19C:
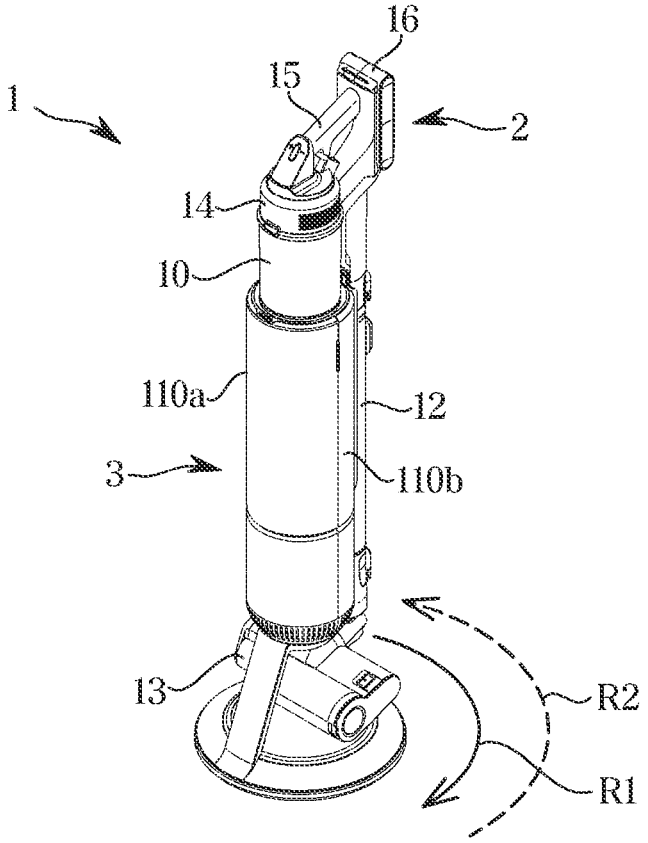
Figure 20A:
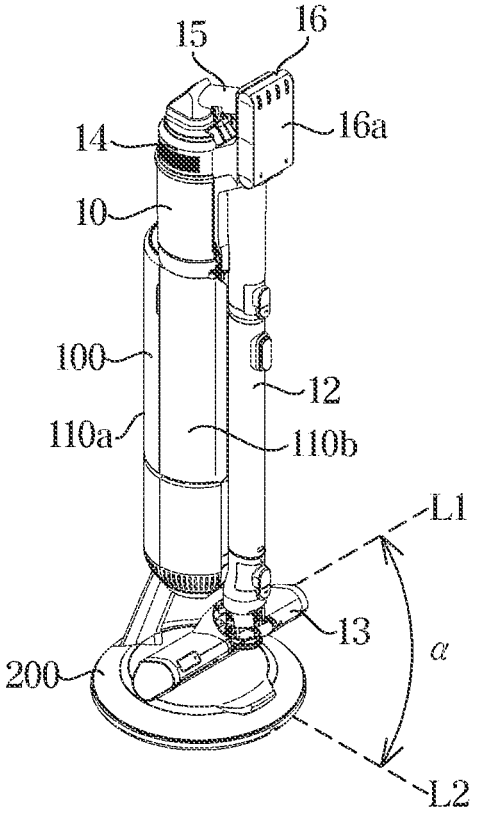
FIGS. 20A and 20B are views for describing a rotation operation of a station of a cleaning device according to an embodiment of the disclosure.
Figure 20B:
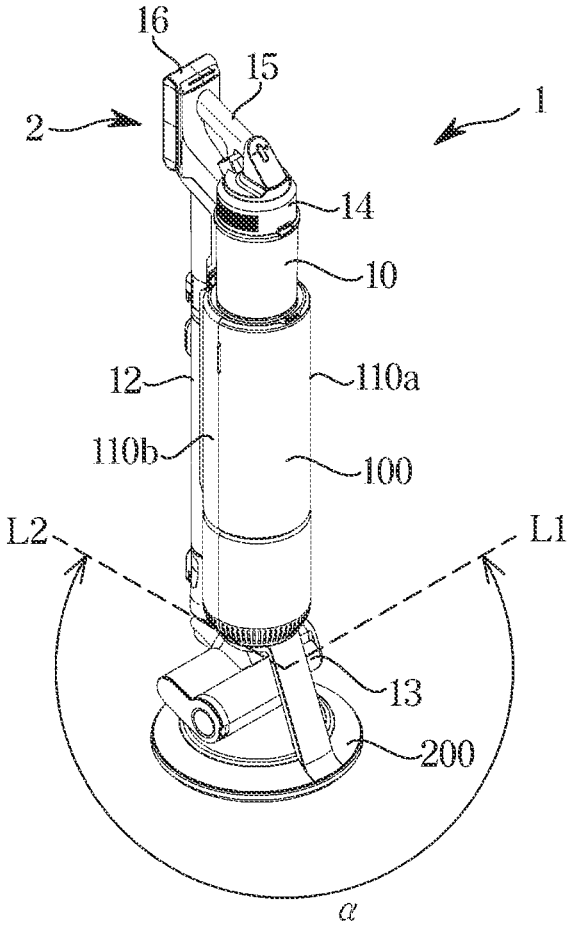

FIGS. 17A-17C are views for describing a rotation operation of the station 3 in response to separation of the cleaner 2 of the cleaning device 1 from the station 3 according to an embodiment of the disclosure. FIGS. 18A-18D are views for describing a rotation operation of the station 3 upon detection of a user present within a preset distance of the cleaning device 1 according to an embodiment of the disclosure. FIGS. 19A-19C are views for describing a rotation operation of the station 3 in response to mounting of the cleaner 2 of the cleaning device 1 on the station 3 according to an embodiment of the disclosure. FIGS. 20A and 20B are views for describing a rotation operation of the station 3 of the cleaning device 1 according to an embodiment of the disclosure.

Referring to FIGS. 17A-17C and 18A-18D, the support 200 of the station 3, according to an embodiment, may be provided to rotate based on whether the cleaner 2 is mounted or not. Also, the support 200 of the station 3, according to an embodiment, may be provided to rotate based on whether the user is present within a preset distance or not. However, the embodiment is not limited thereto, the rotation of the support 200 may be controlled in accordance with various input/setting modes.

The cleaning device 1 may be in a first state in which the cleaner 2 is mounted (or placed) on the station 3 and a second state in which the cleaner 2 is separated from the station 3. The sensing unit 510 of the station 3, which will be described below, may detect whether the cleaner 2 is mounted or not. For example, the sensing unit 510 may include the mounting detection sensor 511 configured to detect the first state and the second state of the cleaning device 1 and conversion between the first state and the second state.

Referring to FIGS. 17A-17C, in the case where the cleaner 2 in a state of being mounted on the station 3 is separated from the station 3, the station 3 may control the rotation driving device 300 to rotate the support 200, thereby locating the extension tube guides 112*b* and 114*b* to face the forward direction of the main body 100 of the station 3. When the user U separates the cleaner 2 from the station 3 to use the cleaner 2, the support 200 may rotate to allow the user to easily mount the cleaner 2 on the station 3 after using the cleaner 2.

Upon receiving a signal corresponding to separation of the cleaner 2 from the mounting detection sensor 511, the processor 500 of the station 3 may control the rotation driving device 300 to rotate the support 200, thereby locating the extension tube guides 112*b* and 114*b* to face the forward direction of the main body 100 of the station 3.

In the case where the cleaner 2, in a state of being mounted on the station 3, is separated from the station 3, the station 3 may control the rotation driving device 300 to rotate the support 200 after a lapse of a preset time. For example, the station 3 may rotate from a state shown FIG. 17B to a state shown in FIG. 17C after about 1 to 2 seconds. The preset time may vary in accordance with settings input by the user. For example, the user may diversely set the time via the inputter 520 of the station 3.

In the case of a cleaning device according to the related art having a non-rotating structure, it may be difficult to mount a cleaner on a station after the user separates the cleaner from the station. For example, in an arrangement in which a first housing is located to face a forward direction of the station and a second housing is located to face a backward direction of the station in consideration of the appearance of the cleaning device, the user may feel difficulty in mounting the cleaner on the station by inserting the cleaner into a space between a wall and the station. In addition, while the user places a dust container of the cleaner on a docking frame of the station in a narrow space, the cleaner may collide with the station and other parts which may cause damage to the other parts.

In contrast, according to embodiments of the disclosure, the support 200 of the station 3 may rotate in response to separation of the cleaner 2 from the station 3 to facilitate mounting of the cleaner 2 on the station 3 by the user later. For example, by rotating the extension tube guides 112*b* and 114*b* of the station 3 to face the forward direction, the user may easily mount the cleaner 2 on the station 3.

Referring to FIGS. 18A-18D, in the case where the user U is present within a preset distance from the cleaning device 1 in a state where the cleaner 2 is mounted on the station 3, the station 3 may control the rotation driving device 300 to rotate the support 200. In accordance with rotation of the support 200, the cleaning device 1 may rotate to a position where the user U easily separate the cleaner 2 from the station 3.

Upon receiving an identification signal of the user present within a preset distance from the station 3 from the user detection sensor 512 in a state where a signal corresponding to mounting of the cleaner 2 is received from the mounting detection sensor 511, the processor 500 of the station 3 may control the rotation driving device 300 to rotate the support 200, thereby locating the extension tube 12 of the cleaner 2 at the front of the main body 100 of the station 3.

For example, the station 3 may control the rotation driving device 300 to rotate the support 200, thereby locating the extension tube 12 of the cleaner 2 at the front of the main body 100 of the station 3. Alternatively, the station 3 may control the rotation driving device 300 to rotate the support 200, thereby locating the extension tube 12 of the cleaner 2 to face the user. However, the embodiment is not limited to the above-described example, and the support 200 may diversely rotate in accordance with settings input by the user.

The station 3 may control the rotation driving device 300 to rotate the support 200 after a lapse of a preset time from detection of the user. For example, the station 3 may rotate from a state shown in FIG. 18B to a state shown in FIG. 18C after about 1 to 2 seconds. The preset time may vary in accordance with settings input by the user. For example, the user may diversely set the time via the inputter 520 of the station 3.

In the case where a signal corresponding to separation of the cleaner 2 is not received from the mounting detection sensor 511 for a preset time after the support 200 rotates, the processor 500 of the station 3, according to an embodiment, may control the rotation driving device 300 to rotate the support 200, thereby locating the extension tube 12 of the cleaner 2 at the rear of the main body 100 of the station 3.

Referring to FIGS. 19A-19C, in the case where the cleaner 2 in a state of being separated from the station 3 is mounted on the cleaner 2, the station 3, according to an embodiment, may control the rotation driving device 300 to rotate the support 200, thereby locating the extension tube guides 112*b* and 114*b*, in which the extension tube 12 is accommodated, to face the backward direction of the main body 100 of the station 3. For example, in the case where the user U mounts the cleaner 2 on the station 3 after using the cleaner 2, the first housing 110*a* of the station 3 having a relatively clean and tidy appearance may be located to face the forward direction of the station 3. The element such as the extension tube 12 of the cleaner 2 may be arranged so as not to be noticed by the user. Alternatively, for example, the element such as the display 540 may be provided on the first housing 110*a* of the station 3, and the element such as the display 540 may be arranged to be exposed at the front.

Upon receiving a signal corresponding to mounting of the cleaner 2 from the mounting detection sensor 511, the processor 500 of the station 3 may control rotation driving device 300 to rotate the support 200, thereby locating the extension tube 12 of the cleaner 2 at the rear of the main body 100 of the station 3.

Furthermore, by locating the first housing 110*a* of the station 3 to face the forward direction of the station 3 in a state where the cleaner 2 is mounted on the station 3, the environment detection sensor 513 and the camera 514 provided at the first housing 110*a* may sense an indoor environment and more accurate information on the indoor environment may be provided to the user.

In addition, by locating the first housing 110*a* of the station 3 to face the forward direction of the station 3 in a state where the cleaner 2 is mounted on the station 3, the suction duct of the suction apparatus 190 provided at the first housing 110*a* may face the forward direction, and thus the air purifying function may be more efficiently performed.

The support 200 may rotate after a lapse of a preset time in the case where the cleaner 2 in a state of being separated from the station 3 is mounted on the station 3. For example, the station 3 may rotate from a state shown in FIG. 19B to a state shown in FIG. 19C after about 1 to 2 seconds. The preset time may vary in accordance with settings input by the user. For example, the user may diversely set the time via the inputter 520 of the station 3.

In addition, the user may input various setting values to control the rotation of the support 200. For example, the user may set at least one of an On/Off of rotation of the support 200, a rotation range of the support 200, a rotation direction (e.g., R1 or R2) of the support 200, and a rotational speed of the support 200. For example, these various setting values may be input to the inputter 520.

In this regard, the processor 500 may set at least one of an On/Off of rotation of the support 200, a rotation range of the support 200, a rotation direction (e.g., R1 or R2) of the support 200, and a rotational speed of the support 200, based on a user input received via the inputter 520.

In addition, the processor 500 may determine whether to activate the operation of controlling the rotation of the support 200 or not based on the user input received via the inputter 520.

Accordingly, the support 200 may operate in an active mode to automatically rotate in accordance with an algorithm stored in the station 3 or in an inactive mode not to be affected by the algorithm stored in the station 3.

For example, an algorithm for performing a rotation operation of the support 200 in the case where the cleaner 2 in a state of being mounted on the station 3 is separated from the station 3 (See FIGS. 17A-17C), a rotation operation of the support 200 in the case where the cleaner 2 is in a state of being mounted on the station 3 and the user U is present within a preset distance (See FIGS. 18A-18D), and a rotation operation of the support 200 in the case where the cleaner 2 in a state of being separated from the station 3 is mounted on the station 3 (See FIGS. 19A-19C) may be stored in the station 3. Besides, a variety of programs may be stored in the station 3.

In the active mode, the support 200 may automatically rotate in accordance with the algorithm stored in the station 3. In the inactive mode, the support 200 may not automatically rotate in accordance with the algorithm stored in the station 3.

For example, in the inactive mode, the station 3 may separately receive a user input and rotate in response to the separate user input.

For example, in the inactive mode, the support 200 may be set not to rotate even when the user U mounts the cleaner 2 on the station 3 or separates the cleaner 2 from the station 3, but rotate only when the user U inputs an ON command to operate the support 200. As another example, the support 200 may be set not to rotate even when the user U approaches the station 3, but rotate only when the user U inputs the ON command to operate the support 200. A separate button, control panel, or the like linked to the rotation of the support 200 may be provided, and a rotation operation of the support 200 desired by the user may be performed in accordance with manipulation by the user U.

Referring to FIGS. 20A and 20B, the rotation range of the support 200 may be diversely set by the user.

An arrangement in which the first housing 110*a* of the main body 100 of the station 3 faces the forward direction of the station 3 and the second housing 110*b* faces the backward direction of the station 3 may be defined as first arrangement, and an arrangement in which the support 200 rotates may be defined as second arrangement. A line of the direction the extension tube 12 of the cleaner 2 faces in the first arrangement of the cleaning device 1 (i.e., backward) may be defined as L1, a line of the direction the extension tube 12 of the cleaner 2 faces in the second arrangement of the cleaning device 1 may be defined as L2, and an angle between the lines L1 and L2 may be defined as angle of rotation (a).

For example, referring to FIG. 20A, when the user U is right-handed, the angle of rotation (a) may be set to a range of about 90° to 120°. Referring to FIG. 20B, when the user U is left-handed, the angle of rotation (a) may be set to a range of about 240° to 270°. However, embodiments are not limited thereto, and the angle of rotation (a) may be diversely set as a value selected by the user.

Although rotation of the support 200 in a clockwise direction (R1) is shown in FIG. 20B, embodiments are not limited thereto. The support 200 may also rotate in a counterclockwise direction (R2).

Hereinafter, an example of a method of controlling the cleaning device 1 according to an embodiment will be described. In the method of controlling the cleaning device 1, the cleaning device 1 according to the previous embodiment may be used. Therefore, descriptions given above with reference to FIGS. 1 to 20B may also be equally applied to the method of controlling the cleaning device 1.

Figure 21:
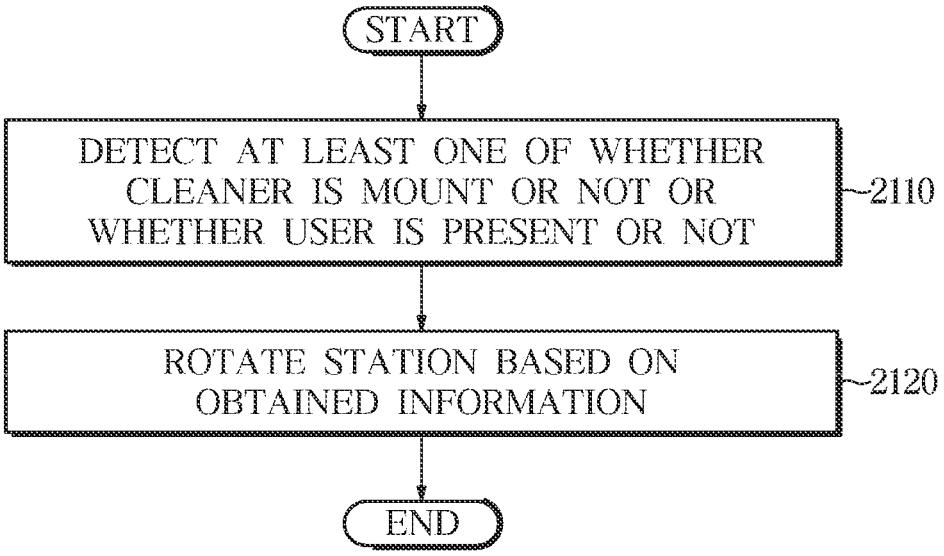
FIG. 21 is a view illustrating a method of controlling a cleaning device according to an embodiment of the disclosure.

FIG. 21 is a view illustrating a method of controlling the cleaning device 1 according to an embodiment of the disclosure.

Referring to FIG. 21, the cleaning device 1 may detect at least one of whether the cleaner 2 is mounted or not or whether the user is present or not at operation 2110.

The station 3 may determine at least one of whether the cleaner 2 is mounted on the station 3 or not or whether the user U is present within a preset distance or not based on an output of the sensing unit 510.

The cleaning device 1 may rotate the station 3 based on the obtained information at operation 2120.

Specifically, the station 3 may control the rotation driving device 300 to rotate the support 200 based on the output of the sensing unit 510.

Figure 22:
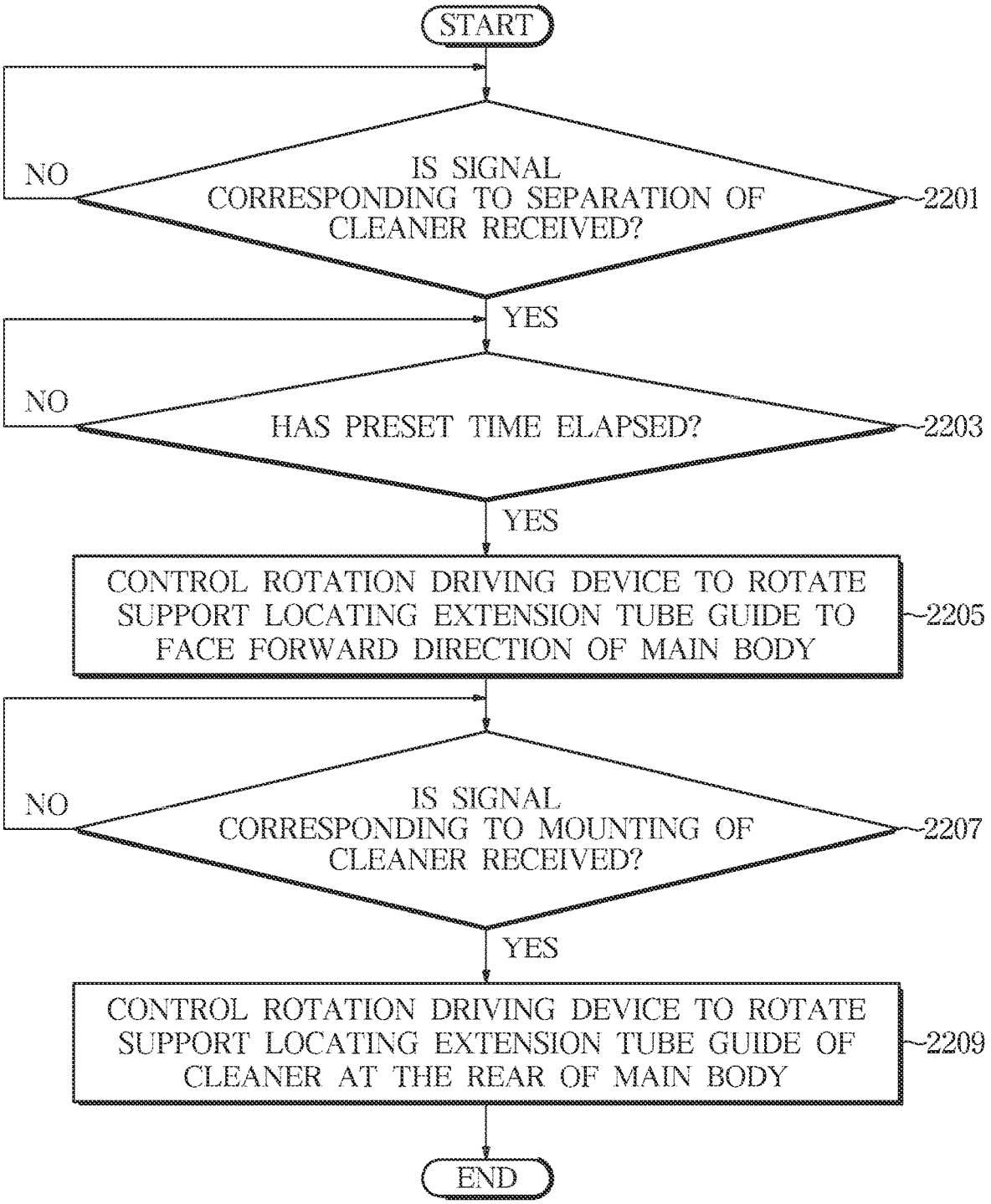
FIG. 22 is a flowchart of a case of controlling rotation of a support of the station based on whether a cleaner is mounted or not in a method of controlling a cleaning device according to an embodiment of the disclosure.

FIG. 22 is a flowchart of a case of controlling rotation of a support of a station based on whether a cleaner is mounted according to an embodiment of the disclosure.

Referring to FIG. 22, in the case where a signal corresponding to separation of the cleaner 2 is received (Yes of 2201) and a preset time has elapsed (Yes of 2203), the cleaning device 1, may control the rotation driving device 300 to rotate support 200, thereby locating the extension tube guides 112*b* and 114*b* to face the forward direction of the main body 100 at operation 2205.

After the lapse of the preset time from the receipt of the signal corresponding to separation of the cleaner 2 from the mounting detection sensor 511, the processor 500 may control the rotation driving device 300 to rotate the support 200, thereby locating the extension tube guides 112*b* and 114*b* to face the forward direction of the main body 100 of the station 3.

However, upon receiving a signal corresponding to separation of the cleaner 2 from the mounting detection sensor 511, the processor 500 may control the rotation driving device 300 to rotate the support 200, thereby locating the extension tube guides 112*b* and 114*b* to face the forward direction of the main body 100 of the station 3 without a preset time delay.

In addition, upon receiving a signal corresponding to mounting of the cleaner 2 (Yes of 2207), the cleaning device 1 may control the rotation driving device 300 to rotate the support 200, thereby locating the extension tube 12 of the cleaner 2 at the rear of the main body 100 at operation 2209.

Upon receiving a signal corresponding to mounting of the cleaner 2 from the mounting detection sensor 511, the processor 500 may control the rotation driving device 300 to rotate the support 200, thereby locating the extension tube 12 of the cleaner 2 at the rear of the main body 100 of the station 3.

In addition, in the case where the cleaner 2 is separated from the station 3 while the rotation driving device 300 is controlled in a state where the cleaner 2 is mounted on the station 3, the processor 500, according to an embodiment, may stop the rotation driving device 300.

Figure 23:
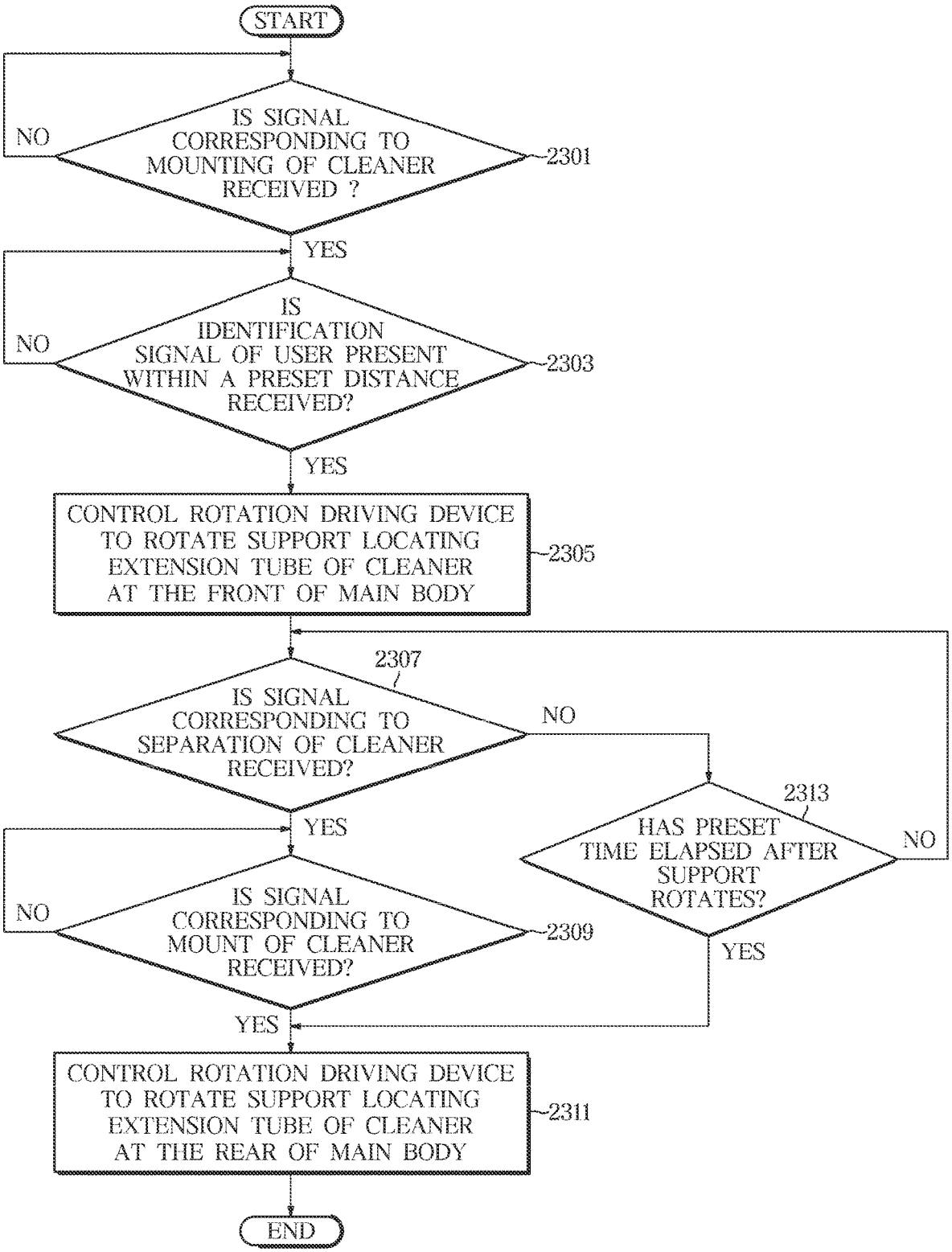
FIG. 23 is a flowchart of a case of controlling rotation of a support of a station based on approach of a user in a method of controlling a cleaning device according to an embodiment of the disclosure.

FIG. 23 is a flowchart of a case of controlling rotation of a support of a station based on whether a user approaches according to an embodiment of the disclosure.

Referring to FIG. 23, when a signal corresponding to mounting of the cleaner 2 is received in operation 2301, and upon receiving an identification signal of a user present within a preset distance in operation 2303, the cleaning device 1 may control the rotation driving device 300 to rotate the support 200, thereby locating the extension tube 12 of the cleaner 2 at the front of the main body 100 of the station 3 at operation 2305.

Upon receiving an identification signal of the user present within the preset distance from the station 3 from the user detection sensor 512 in a state where a signal corresponding to mounting of the cleaner 2 is received from the mounting detection sensor 511, the processor 500 may control the rotation driving device 300 to rotate the support 200, thereby locating the extension tube 12 of the cleaner 2 at the front of the main body 100 of the station 3.

In addition, when a signal corresponding to separation of the cleaner 2 is received in operation 2307 and upon receiving a signal corresponding to mounting of the cleaner 2 in operation 2309, the cleaning device 1 may control the rotation driving device 300 to rotate the support 200, thereby locating the extension tube 12 of the cleaner 2 at the rear of the main body 100 of the station 3 at operation 2311.

Upon receiving a signal corresponding to mounting of the cleaner 2 after a signal corresponding to separation of the cleaner 2 is received from the mounting detection sensor 511, the processor 500 may control the rotation driving device 300 to rotate the support 200, thereby locating the extension tube 12 of the cleaner 2 at the rear of the main body 100 of the station 3.

Also, in the case where the cleaner 2 is separated from the station 3 while the rotation driving device 300 is controlled in a state where the cleaner 2 is mount on the station 3, the processor 500 may stop the rotation driving device 300.

In addition, when a signal corresponding to separation of the cleaner 2 is not received in operation 2307, and a preset time has elapsed from rotation of the support 200 in operation 2313, the cleaning device 1 may control the rotation driving device 300 to rotate the support 200, thereby locating the extension tube 12 of the cleaner 2 at the rear of the main body 100 of the station 3 at operation 2311.

That is, in the case where a signal corresponding to separation of the cleaner 2 is not received from the mounting detection sensor 511 for a preset time from rotation of the support 200, the processor 500 may control the rotation driving device 300 to rotate the support 200, thereby locating the extension tube 12 of the cleaner 2 at the rear of the main body 100 of the station 3.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cleaning device comprising:

a cleaner comprising a suction head, a dust container to collect dust contained in air vacuumed through the suction head, and an extension tube connecting the suction head with the dust container; and a station on which the cleaner is mounted, wherein the station comprises:

a main body having a powered suction device, the powered suction device configured to vacuum dust of the dust container of the cleaner and contain the dust, a support configured to support the main body and guide rotation of the main body, a rotation driving device disposed in the support and configured to transmit a rotational force to the support, a sensor configured to detect at least one of whether the cleaner is mounted or whether a user is present within a preset distance from the station, and a processor configured to control the rotation driving device to rotate the support based on information detected by the sensor.

2. The cleaning device according to claim 1, wherein the support comprises:

a first support supported by a floor; and a second support coupled to the main body and rotatable with respect to the first support.

3. The cleaning device according to claim 2, wherein the first support further comprises a support member provided to support a bottom of the second support and reduce a frictional force between the first support and the second support.

4. The cleaning device according to claim 2, wherein the second support further comprises a protrusion extending downward from a bottom of the second support, and wherein the first support further comprises a recess in which the protrusion of the second support is rotatably accommodated, and a stopper extending from the recess toward the protrusion to prevent dislocation of the protrusion.

5. The cleaning device according to claim 2, wherein the rotation driving device comprises:

a driving motor disposed at one of the first support and the second support and comprising a rotary shaft;

a first gear connected to the rotary shaft of the driving motor and receiving the rotational force from the driving motor; and a second gear disposed at the other of the first support and the second support and engaged with the first gear.

6. The cleaning device according to claim 1, wherein the main body of the station further comprises an extension tube guide provided to correspond to the extension tube of the cleaner in a state where the cleaner is mounted on the station, and wherein in response to separation of the cleaner from the station, the processor is further configured to control the rotation driving device to rotate the support, thereby locating the extension tube guide to face a forward direction of the main body of the station.

7. The cleaning device according to claim 6, wherein the processor is further configured to control the rotation driving device after a lapse of a preset time from the separation of the cleaner from the station.

8. The cleaning device according to claim 6, wherein upon detection of the user present within the preset distance from the station in a state where the cleaner is mounted on the station, the processor is further configured to control the rotation driving device to rotate the support, thereby locating the extension tube of the cleaner at a front of the main body of the station.

9. The cleaning device according to claim 8, wherein in the case where the cleaner is not separated from the station for a preset time after the support rotates, the processor is further configured to control the rotation driving device to rotate the support, thereby locating the extension tube of the cleaner at a rear of the main body of the station.

10. The cleaning device according to claim 8, wherein in response to mounting of the cleaner on the station after the cleaner is separated from the station, the processor is further configured to control the rotation driving device to rotate the support, thereby locating the extension tube of the cleaner at a rear of the main body of the station.

11. The cleaning device according to claim 10, wherein in the case where the cleaner is separated from the station while the rotation driving device is controlled in a state where the cleaner is mounted on the station, the processor is further configured to stop the rotation driving device.

12. The cleaning device according to claim 1, wherein the station further comprises an inputter configured to receive an input from the user.

13. The cleaning device according to claim 12, wherein the processor is further configured to set at least one of an On/Off of rotation of the support, a rotation range of the support, a rotation direction of the support, and a rotational speed of the support, based on a user input received via the inputter.

14. The cleaning device according to claim 12, wherein the processor is further configured to control whether to activate an operation of controlling rotation of the support or not based on a user input received via the inputter.

* * * * *